US006981898B2

(12) United States Patent
Akama et al.

(10) Patent No.: US 6,981,898 B2
(45) Date of Patent: Jan. 3, 2006

(54) CONNECTOR

(75) Inventors: Junichi Akama, Shinagawa (JP); Masahiro Hamazaki, Shinagawa (JP); Tadashi Kumamoto, Shinagawa (JP); Manabu Shimizu, Shinagawa (JP); Hideo Miyazawa, Shinagawa (JP); Fumio Kurotori, Konosu (JP); Moriyuki Ueno, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/613,028

(22) Filed: Jul. 7, 2003

(65) Prior Publication Data

US 2004/0029410 A1 Feb. 12, 2004

Related U.S. Application Data

(63) Continuation of application No. PCT/JP02/00677, filed on Jan. 30, 2002.

(51) Int. Cl.
*H01R 13/648* (2006.01)

(52) U.S. Cl. ..... 439/608; 439/108; 439/931; 439/941

(58) Field of Classification Search ..... 439/608, 439/108, 931, 941, 79, 101, 606
See application file for complete search history.

(56) References Cited

U.S. PATENT DOCUMENTS

| | | | | |
|---|---|---|---|---|
| 4,762,500 A * | 8/1988 | Dola et al. | 439/79 |
| 5,116,230 A * | 5/1992 | Dechelette et al. | 439/101 |
| 5,160,273 A | 11/1992 | Carney | |
| 5,429,521 A * | 7/1995 | Morlion et al. | 439/108 |
| 5,718,592 A * | 2/1998 | Hosler et al. | 439/63 |
| 6,150,606 A * | 11/2000 | Matsumoto et al. | 174/35 R |
| 6,183,302 B1 | 2/2001 | Daikuhara et al. | |
| 6,210,230 B1 * | 4/2001 | Lai | 439/610 |
| 6,435,913 B1 * | 8/2002 | Billman | 439/608 |
| 6,461,202 B2 * | 10/2002 | Kline | 439/701 |
| 6,540,559 B1 * | 4/2003 | Kemmick et al. | 439/608 |

FOREIGN PATENT DOCUMENTS

| | | |
|---|---|---|
| EP | 0 510 995 A2 | 10/1992 |
| EP | 0 634 817 A2 | 1/1995 |
| JP | 3-501185 | 3/1991 |
| JP | 2000-67955 | 3/2000 |
| JP | 2000-68006 | 3/2000 |
| JP | 2000-68007 | 3/2000 |

* cited by examiner

*Primary Examiner*—Truc Nguyen
(74) *Attorney, Agent, or Firm*—Staas & Halsey LLP

(57) ABSTRACT

A connector includes multiple pairs of signal contacts arranged in a housing, and facilitates the wiring design and the wiring operation for substrates. The two signal contacts in each of the multiple pairs are arranged at a distance in the longitudinal direction of the housing. With this arrangement, excellent coupling can be established between the two signal contacts, and signals can be balanced-transmitted without causing a phase difference. Also, the lengths of each pair of wires of a wiring substrate to be connected to the multiple pairs of signal contacts can be easily made uniform. Accordingly, there is no need to prepare excessive wiring areas, and the substrate wiring design and the wiring operation can be simplified.

16 Claims, 17 Drawing Sheets

2
3b
6b
4c−1
5b
8b
5b-1
4c−2
4d−1
3b-1
4d
4c
3b-2
4d−2
X2
Y2
Y1
X1
1
3a
6a
5a-1
4b-1
4b
5a
3a-3
4a
4a-1
3a-1
4b-2
7a
7a
4a-2
3a-2
8a
Y1
X1
Z1
Z2
X2
Y2

CONNECTOR

This application is a continuing application, filed under 35 U.S.C. §111(a), of International Application PCT/JP02/00677, filed Jan. 30, 2002.

BACKGROUND OF THE INVENTION

1. Field of the Invention

The present invention relates to connectors that are used in computers, servers, and routers, and more particularly, to a connector that has multiple pairs of signal contacts and is suitable especially for balanced transmission.

2. Description of the Related Art

In recent years, there has been an increasing demand for a large amount of data transmission, as computers and computer networks have been rapidly developed. Especially, video data transmission needs to be carried out at a speed of 1 Gbit/s or higher.

For this type of data transmission, unbalanced transmission methods have been widely employed conventionally, because they are advantageous in terms of costs. By the unbalanced transmission methods, however, it is difficult to avoid adverse influence of noise. Therefore, to carry out high-speed data transmission, it is more preferable to employ a balanced transmission method that can provide resistibility to noise.

FIGS. 1A and 1B illustrate an example of a conventional connector device of a balanced transmission type. The connector device shown in FIG. 1A has a jack connector 1 and a mating plug connector 2.

The jack connector 1 includes pairs of signal contacts 4*a* and 4*b* and ground contacts 5*a* in a housing 3*a* that is made of an insulating material and is formed longitudinally in the direction of X1-X2 of FIG. 1A.

The housing 3*a* has a concavity 6*a* formed longitudinally in the direction of X1-X2. Each pair of signal contacts 4*a* and 4*b* has upper ends 4*a*-1 and 4*b*-1 protruding in the direction of Z1 from the bottom wall 3*a*-1 of the housing 3*a* and extending along the side walls 3*a*-2 and 3*a*-3 within the concavity 6*a*. The signal contacts 4*a* and 4*b* in each pair face each other in the direction of Y1-Y2. A ground contact 5*a* having a fork-like top end 5*a*-1 is provided between each two neighboring pairs of signal contacts 4*a* and 4*b*.

The lower ends 4*a*-2, 4*b*-2, and 5*a*-2 (not shown) of the signal contacts 4*a* and 4*b* and the ground contacts 5*a* each has a pin-like shape extending in the direction of Z2 and is inserted into a hole 7*a* formed in a substrate 8*a*. In this structure, the lower ends 4*a*-2, 4*b*-2, and 5*a*-2 are connected to a printed circuit (not shown) formed on the substrate 8*a*.

The plug connector 2 has a shape corresponding to the jack connector 1, and includes pairs of signal contacts 4*c* and 4*d* and ground contacts 5*b* in a housing 3*b* that is made of an insulating material and is formed longitudinally in the direction of X1-X2 of FIG. 1B.

The housing 3*b* has protrusions 3*b*-1 arranged at predetermined intervals in the direction of X1-X2 within a concavity 6*b*. Each pair of signal contacts 4*c* and 4*d* has pin-like upper ends 4*c*-1 and 4*d*-1 protruding from the bottom wall 3*b*-2 of the housing 3*b* and extending along the both sides of each corresponding protrusion 3*b*-1 in the direction of Y1-Y2. A ground contact 5*b* having a flat top end 5*b*-1 is provided between each two neighboring pairs of signal contacts 4*c* and 4*d*.

The lower ends 4*c*-2, 4*d*-2, and 5*b*-2 (not shown) of the signal contacts 4*c* and 4*d* and the ground contacts 5*b* each has a tongue-like top end that is bent in the direction of Y1-Y2 of FIG. 1B. This tongue-like top end is fixed to a pad (not shown) formed on a substrate 8*b*, and is thus connected to a printed circuit (not shown) formed on the substrate 8*b*.

The plug connector 2 is connected to the jack connector 1, so that the signal contacts 4*a* and 4*b* are brought into contact with the signal contacts 4*c* and 4*d*, and that the ground contacts 5*a* sandwich the corresponding ground contacts 5*b*. Thus, the signal contacts and the ground contacts are electrically connected to one another. If a positive signal is transmitted through the signal contacts 4*a* and 4*c* in this case, a negative signal is transmitted through the signal contacts 4*b* and 4*d*.

With the above conventional connector device, however, there is a problem that desired balanced transmission cannot be carried out, because the mating lower ends 4*c*-2 and 4*d*-2 extend in the opposite directions and cannot establish preferable coupling.

Meanwhile, a wiring pattern may be formed on the substrates, so that one ends of the wires extend from either one side (the Y1 side or the Y2 side in FIG. 1B) of the longitudinal walls of the housings 3*a* and 3*b*, while the other ends of the wires are connected to a terminal unit or the like provided at a predetermined location on a line extending from the one side. In such a case, however, wires of uniform lengths cannot be provided between the terminal unit and each pair of signal contacts, because one of the signal contacts in each pair is located farther away from the terminal unit. The variation of the wire lengths causes phase difference between signals subject to balanced transmission through each pair of signal contacts. The phase difference results in noise, and makes the characteristic impedance unstable.

To prevent the noise generation and stabilize the characteristic impedance, the lengths of wires to be connected to the signal contacts closer to the terminal unit are adjusted to the same lengths as the lengths of the wires to be connected to the signal contacts farther from the terminal unit.

However, the employment of wires at the unnecessary locations, i.e., the excessive lengths of wires, only complicates the wiring design and the wiring operation for the substrates.

SUMMARY OF THE INVENTION

It is therefore an object of the present invention to provide a connector that has multiple pairs of signal contacts arranged in a housing, and facilitates the wiring design and the wiring operation for substrates.

The connector of the present invention has multiple pairs of signal contacts arranged in a housing. In this connector, the two adjacent signal contacts that are paired with each other are arranged at a distance in the longitudinal direction of the housing. When the signal contacts of the connector are connected to a terminal unit or the like of a substrate facing in a direction perpendicular to the longitudinal direction of the housing, the lengths of each pair of wires for connecting the multiple pairs of signal contacts to the terminal unit or the like can be made uniform. Accordingly, there is no need to prepare excessive wiring areas, and the wiring design and the wiring operation for substrates can be simplified.

Here, the connector is either a jack connector or a plug connector. In this connector, the multiple pairs of signal contacts are of a surface mounting type, and have bent ends in contact with a pad on a substrate. The effects of the present invention can be maximized if these bent ends of all the multiple pairs of signal contacts extend in parallel with one another. However, the arrangement of the signal contacts is not limited to this, and each of the signal contacts may have a pin-like top end to be inserted into each corresponding through hole formed in the substrate. In such a case, the multiple pairs of signal contacts are aligned in arrays in the transverse direction of the housing, so that the effects of the present invention can be maximized in the wiring design and the wiring operation for a number of substrates required in accordance with the number of the arrays of signal contacts.

The connector of the present invention may further include an array internal ground contact between each neighboring pairs of the multiple pairs of signal contacts. With this arrangement, crosstalk between each two neighboring pairs of signal contacts can be reduced. The array internal ground contact is large enough to shield the multiple pairs of signal contacts from each neighboring pair.

The connector of the present invention may further include an array intermediate ground contact between each two neighboring arrays of the multiple pairs of signal contacts. With this arrangement, crosstalk between each two neighboring arrays of the multiple pairs of signal contacts can be reduced. The array intermediate ground contact has an exposed flat panel part in the housing. Also, the length of the housing in the longitudinal direction is greater than the distance between each pair of signal contacts of the multiple pairs of signal contacts.

The connector of the present invention may further include a shielding layer that is formed on the exterior of the housing. The shielding layer effectively shields the connector from external electromagnetic waves.

In the connector of the present invention, each of the multiple pairs of signal contacts prevents noise between each pair of signal contacts through which signals travel in balanced transmission. Thus, the characteristic impedance can be stabilized even in a high-speed signal transmitting operation.

The present invention also provides a connector that includes: signal contacts that are arranged in two arrays; and ground contacts that divide each array of signal contacts into multiple pairs. In this connector, the multiple pairs of signal contacts are adjacent to one another over the entire length of each signal contact. Accordingly, coupling is established between each pair of signal contacts, and excellent balanced transmission can be carried out. Also, when the connector is mounted to a substrate, pairs of wires for connecting each pair of signal contacts to a terminal unit or the like on the substrate can be made uniform, because the multiple pairs of signal contacts are adjacent to one another. Accordingly, there is no need to prepare excessive wiring areas on the substrate, and the substrate wiring design and the wiring operation can be simplified.

In the above structure, substrate contact parts of the multiple pairs of signal contacts arranged in one of the two arrays may extend in the opposite direction from substrate contact parts of the multiples pairs of signal contacts arranged in the other one of the two arrays. Accordingly, each two adjacent signal contacts of the two arrays extend in the opposite directions. Thus, excellent high-density balanced transmission can be realized.

In the above structure, substrate contact parts of the multiple pairs of signal contacts arranged in one of the two arrays may face substrate contact parts of the multiple pairs of signal contacts arranged in the other one of the two arrays, and all the substrate contact parts extend in the same direction. Accordingly, the multiple pairs of signal contacts adjacent to one another are arranged on the two opposite faces of the substrate. Thus, excellent high-density balanced transmission can be realized.

In the above structure, a pair of signal contacts arranged in one of the two arrays and a pair of signal contacts arranged in the other one of the two arrays may exist between each two neighboring ground contacts. With this arrangement, each pair of signal contacts can be effectively shielded from the neighboring pairs of signal contacts.

In the above structure, a pair of signal contacts arranged in one of the two arrays and a pair of signal contacts arranged in the other array that faces the one of the two arrays via an insulating member may exist between each two neighboring ground contacts. With this arrangement, a plug connector can be formed.

In the above structure, a pair of signal contacts arranged in one of the two arrays and a pair of signal contacts arranged in the other array that faces the one of the two arrays via a space may exist between each two neighboring ground contacts. With this arrangement, a jack connector can be formed.

In the above structure, the ground contacts may each have a panel-like shape, and be provided in both two arrays. This is an example of the structure of a ground contact.

In the above structure, each of the ground contacts may be provided across both two arrays, and have two substrate contact parts facing each other. Accordingly, the ground contacts have the same structures as the signal contacts, and thus are extended toward the substrate.

In the above structure, each of the ground contacts may have a pair of contact parts. In this case, one of the pair of contact parts is aligned with substrate contact parts of the multiple pairs of signal contacts arranged in one of the two arrays, while the other one of the pair of contact parts is aligned with substrate contact parts of the multiple pairs of signal contacts arranged in the other one of the two arrays. With this arrangement, the substrate contact parts of the ground contacts can be aligned with the substrate contact parts of the signal contacts. Thus, the substrate wiring design and wiring operation can be further simplified.

In the above structure, first parts of the signal contacts to be connected to a mating connector may extend in a direction perpendicular to second parts of the signal contacts to be connected to terminals on the substrate. Alternatively, the first parts of the signal contacts to be connected to a mating connector may extend in the opposite direction from the second parts of the signal contacts to be connected to terminals on the substrate.

In the above structure, the signal contacts arranged in the two arrays may be aligned at intervals in the longitudinal direction of the connector.

The connector of the present invention may further include other signal contacts that are provided in each array. These other signal contacts in each array are arranged at intervals, without the ground contacts being interposed among the other signal contacts. The arrangement of signal contact without ground contact is suitable for unbalanced transmission at a relatively low speed. Accordingly, a complex connector that is suitable for both balanced transmission and unbalanced transmission can be realized with the above structure.

The present invention also provides an electronic device that includes a wiring substrate and a connector that is mounted to the wiring substrate. In this electronic device, the connector is one of the above described connectors of the present invention. This electronic device may be a printed wiring board to which one of the connectors of the present invention is mounted.

DESCRIPTION OF THE PREFERRED EMBODIMENTS

The following is a detailed description of preferred embodiments of the present invention, with reference to the accompanying drawings.

First Embodiment

Referring first to FIGS. 2A through 6B, a connector in accordance with a first embodiment of the present invention will be described.

The connector in accordance with this embodiment is made up of a jack connector and a plug connector that can be connected to the jack connector. The jack connector and the plug connector are set as a pair on substrates, so as to connect multiple substrates to one another. The wiring substrates onto which the connectors of the present invention are mounted are one embodiment of an electronic device of the present invention.

Figure 2A:
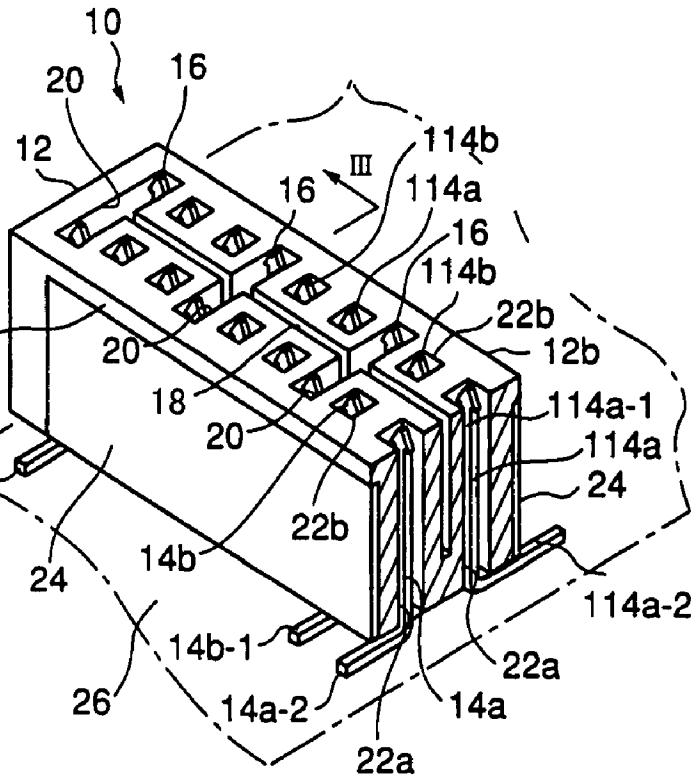
FIG. 2A is a perspective view of a jack connector in accordance with a first embodiment of the present invention.

A jack connector 10 has an array of pairs of signal contacts 14*a* and 14*b*, another array of pairs of signal contacts 114*a* and 114*b*, and ground contacts 16 in a housing 12 that is made of an insulating material and is formed longitudinally in the direction of X1-X2 of FIG. 2A.

The housing 12 has a slit 18 that is formed longitudinally in the direction of X1-X2, and short slits 20 that cross the slit 18 at right angles. Each area surrounded by the slit 18 and the slits 20 has a pair of holes 22*a* and 22*b* formed therein. Accordingly, the holes 22*a* and 22*b* are arranged as multiple pairs in the direction of X1-X2, and as two arrays in the direction of Y1-Y2. Each of the holes 22*a* and 22*b* has a narrower end at the Z1 side.

Each of the signal contacts 14*a*, 14*b*, 114*a*, and 114*b* has an L-shape. Each of the upper ends 14*a*-1, 14*b*-1, 114*a*-1, and 114*b*-1 of the signal contacts 14*a*, 14*b*, 114*a*, and 114*b* is bent in an angular shape (see FIG. 6A), and each of the lower ends 14*a*-2, 14*b*-2, 114*a*-2, and 114*b*-2 is bent at the right angle (the upper ends 114*b*-1 and the lower ends 114*b*-2 are not shown). The upper ends 14*a*-1, 14*b*-1, 114*a*-1, and 114*b*-1 are to be connected to a mating connector, and will be hereinafter referred to as connector contact parts. The lower ends 14*a*-2, 14*b*-2, and 114*a*-2, and 114*b*-2 are to form the contact of the substrate side, and will be hereinafter referred to as substrate contact parts.

The signal contacts 14*a* and 14*b*, and the signal contacts 114*a* and 114*b*, are set as pairs of signal contacts. Each pair of signal contacts 14*a* and 14*b*, and signal contacts 114*a* and 114*b*, is inserted into each corresponding pair of holes 22*a* and 22*b* from the Z2 side. The upper ends 14*a*-1, 14*b*-1, 114*a*-1, and 114*b*-1 stand along the side walls of the corresponding holes 22*a* and 22*b*. The lower ends 14*a*-2 and 14*b*-2 are bent at the bottom end of the housing 12, and extend in the direction of Y2, i.e., extend in parallel with one another from a longitudinal side wall 12*a* of the housing 12. The lower ends 114*a*-2 and 114*b*-2 of the signal contacts 114*a* and 114*b* are bent at the bottom end of the housing 12, and extend in the direction of Y1, i.e., extend in parallel with one another from a longitudinal side wall 12*b* of the housing 12. Accordingly, the signal contacts are arranged as multiple rows in the direction of X1-X2, and as two arrays in the direction of Y1-Y2.

Figure 3:
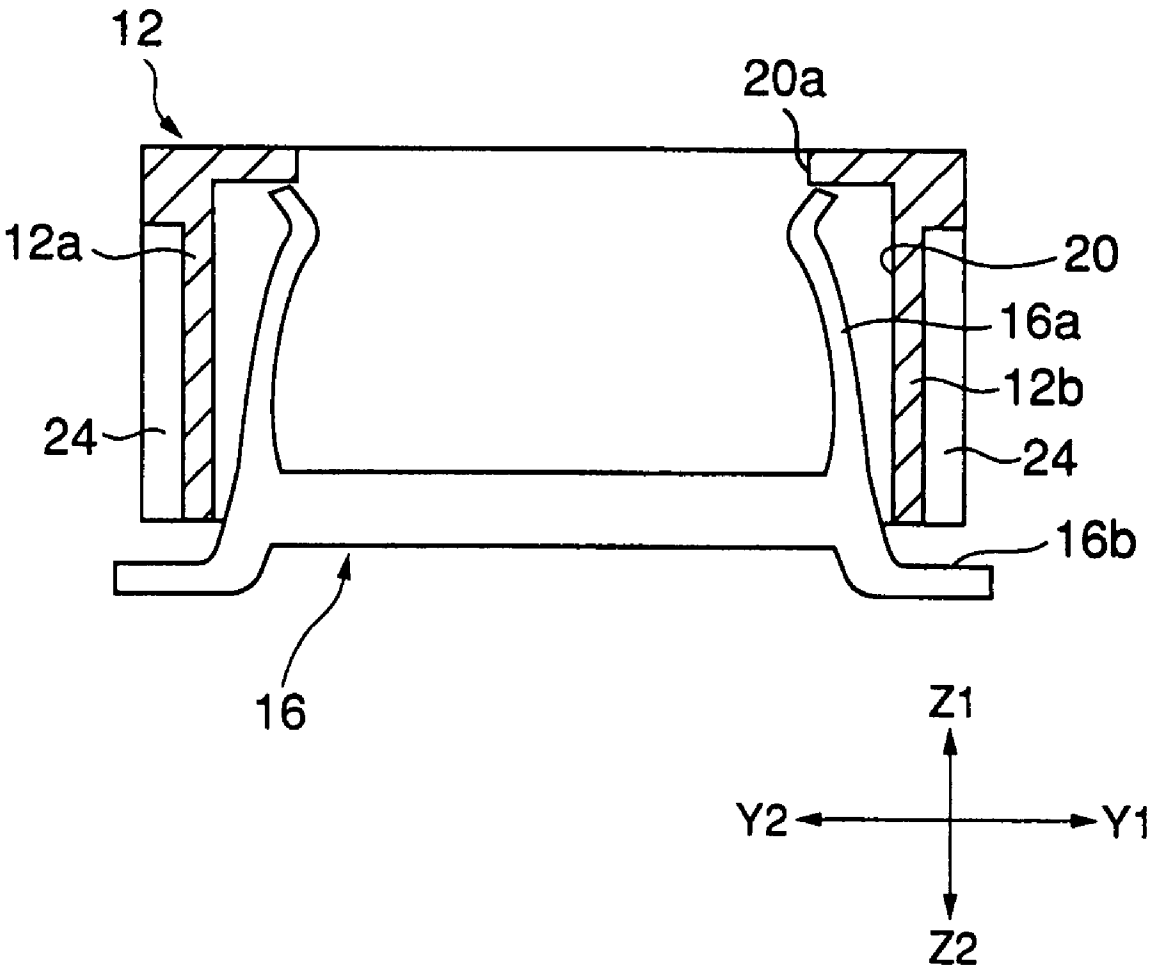
FIG. 3 is a sectional view of the jack connector, taken along the line III—III of FIG. 2A.

As shown in FIG. 3, each of the ground contacts 16 has upper ends 16*a* branching apart in the direction of Y1-Y2, and the tops of the angular upper ends 16*a* are inclined toward each other. The lower ends 16*b* of each of the ground contacts 16 also branch apart in the direction of Y1-Y2, and are bent in the horizontal direction. The ground contacts 16 are array internal ground contacts that shield the neighboring pairs of signal contacts 14*a*, 14*b*, 114*a*, and 141*b* from one another. The upper ends 16*a* of each of the ground contacts 16 protrude up to immediately below the narrow opening 20*a* of each corresponding slit 20 of the housing 12. The lower ends 16*b* of each of the ground contacts 16 extend in both directions of Y1 and Y2. A shielding layer 24 is provided on either of the longitudinal side walls 12*a* and 12*b* of the housing 12.

The lower ends 14*a*-2, 14*b*-2, 114*a*-2, 114*b*-2, and 16*b* of the signal contacts 14*a*, 14*b*, 114*a*, 114*b*, and the ground contacts 16, are joined to a pad (not shown) formed on a wiring substrate 26 (also referred to as the "printed circuit board" or simply as the "substrate"in this specification), and thus are connected to a printed circuit (not shown) formed on the substrate 26.

Figure 2B:
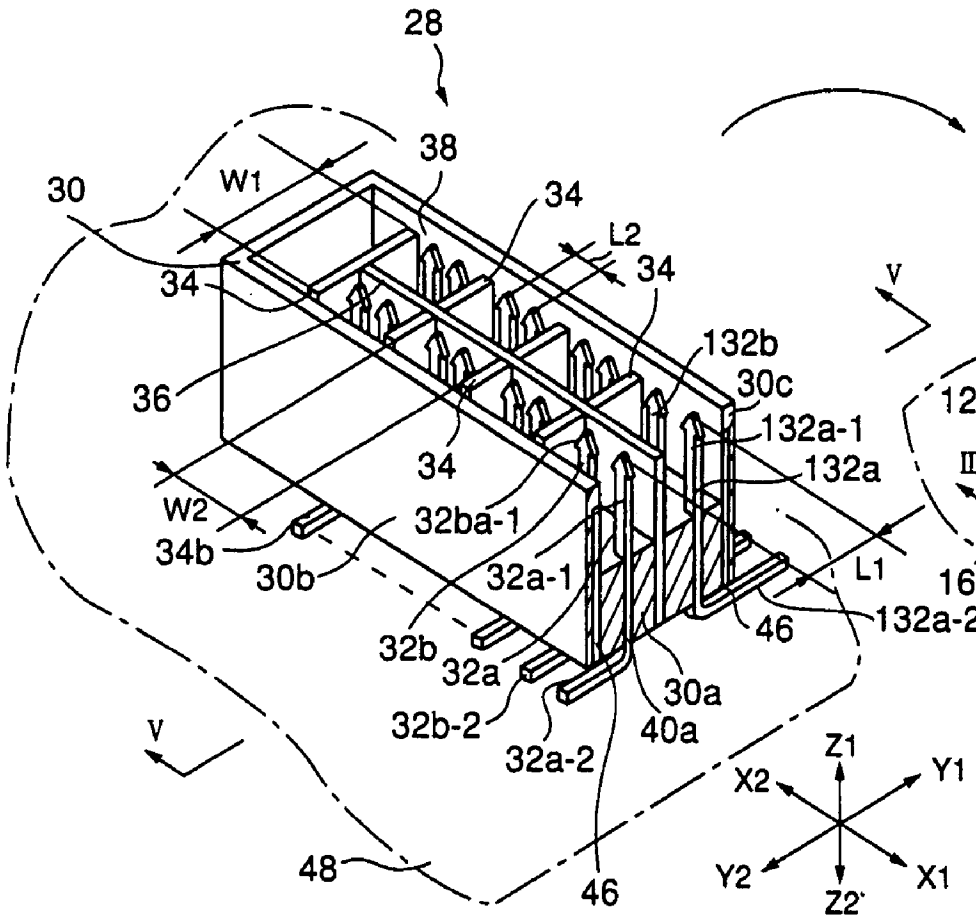
FIG. 2B is a perspective view of a plug connector in accordance with the first embodiment of the present invention.

The plug connector 28 includes an array of pairs of signal contacts 32*a* and 32*b*, an array of pairs of signal contacts 132*a* and 132*b*, array internal ground contacts 34, and array intermediate ground contacts 36, all of which are arranged in a housing 30 that is made of an insulating material and is formed longitudinally in the direction of X1-X2 of FIG. 2B.

Figure 5:
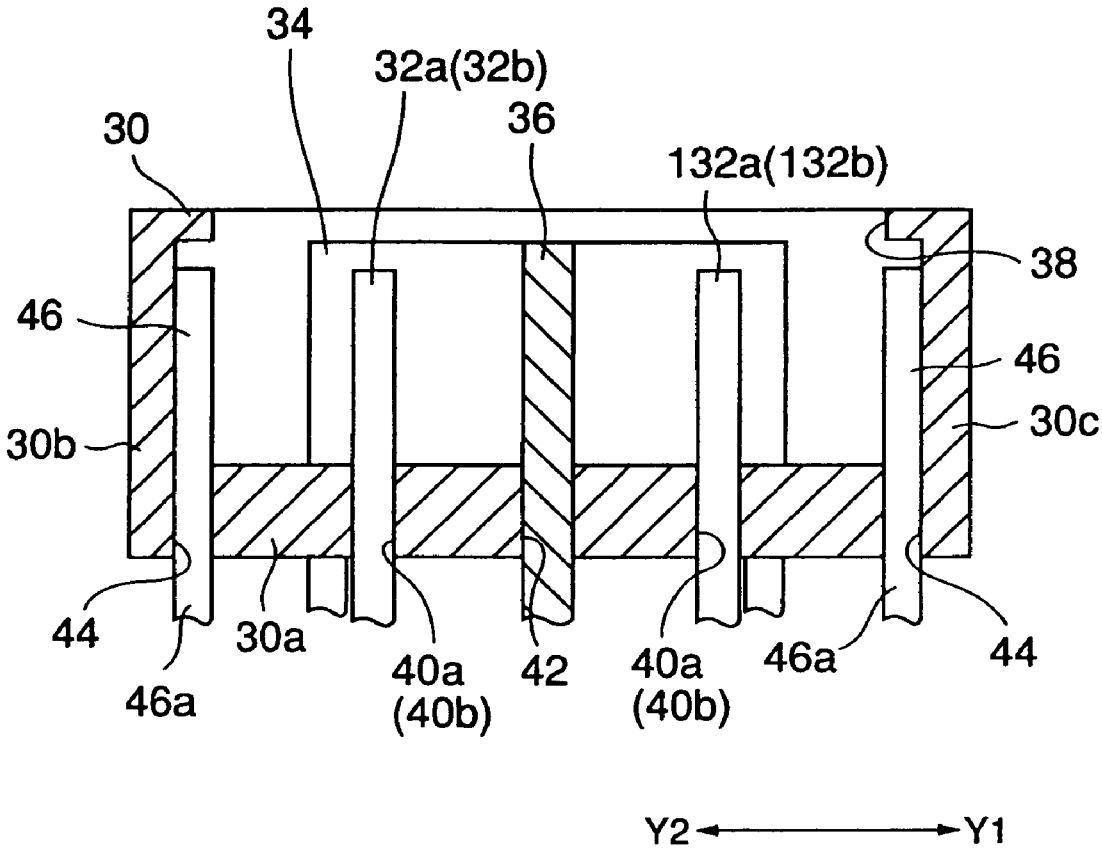
FIG. 5 is a sectional view of the plug connector, taken along the line V—V of FIG. 2B.

The housing 30 has a concavity 38 formed longitudinally in the direction of X1-X2. As shown in FIG. 5, holes 40*a* and 40*b* are formed through the bottom wall 30*a*, and slits 42 are longitudinally and transversely formed so as to partition each pair of holes 40*a* and 40*b* off the other pairs. Also, two slits 44 are formed along the inner surfaces of the side walls of the housing 30. The arrangement of the holes 40*a* and 40*b* and the slits 42 corresponds to the arrangement of the holes 22*a* and 22*b* and the slits 18 and 20 of the jack connector 10.

Each of the signal contacts 32*a*, 32*b*, 132*a*, and 132*b* has an L-shape. Each one signal contact 32*a* is paired with one signal contact 32*b*, and each one signal contact 132*a* is paired with one signal contact 132*b*. Each pair of signal contacts 32*a* and 32*b*, and signal contacts 132*a* and 132*b*, is inserted into each corresponding pair of holes 40*a* and 40*b* from the Z2 side. The upper ends 32*a*-1, 32*b*-1, 132*a*-1, and 132*b*-1 of the signal contacts 32*a*, 32*b*, 132*a*, and 132*b* stand within the concavity 38 (the upper ends 132*b*-1 are not shown). The lower ends 32*a*-2 and 32*b*-2 of the signal contacts 32*a* and 32*b* are bent at the bottom end of the housing 30, and extend in parallel with one another from the side wall 30*b* on the Y2 side. The lower ends 132*a*-2 and 132*b*-2 of the signal contacts 132*a* and 132*b* are bent at the bottom end of the housing 30, and extend in parallel with one another from the side wall 30*c* on the Y1 side (the lower ends 132*b*-2 are not shown). Accordingly, the signal contacts are arranged as multiple rows in the direction of X1-X2, and as two arrays in the direction of Y1-Y2.

Figure 4:
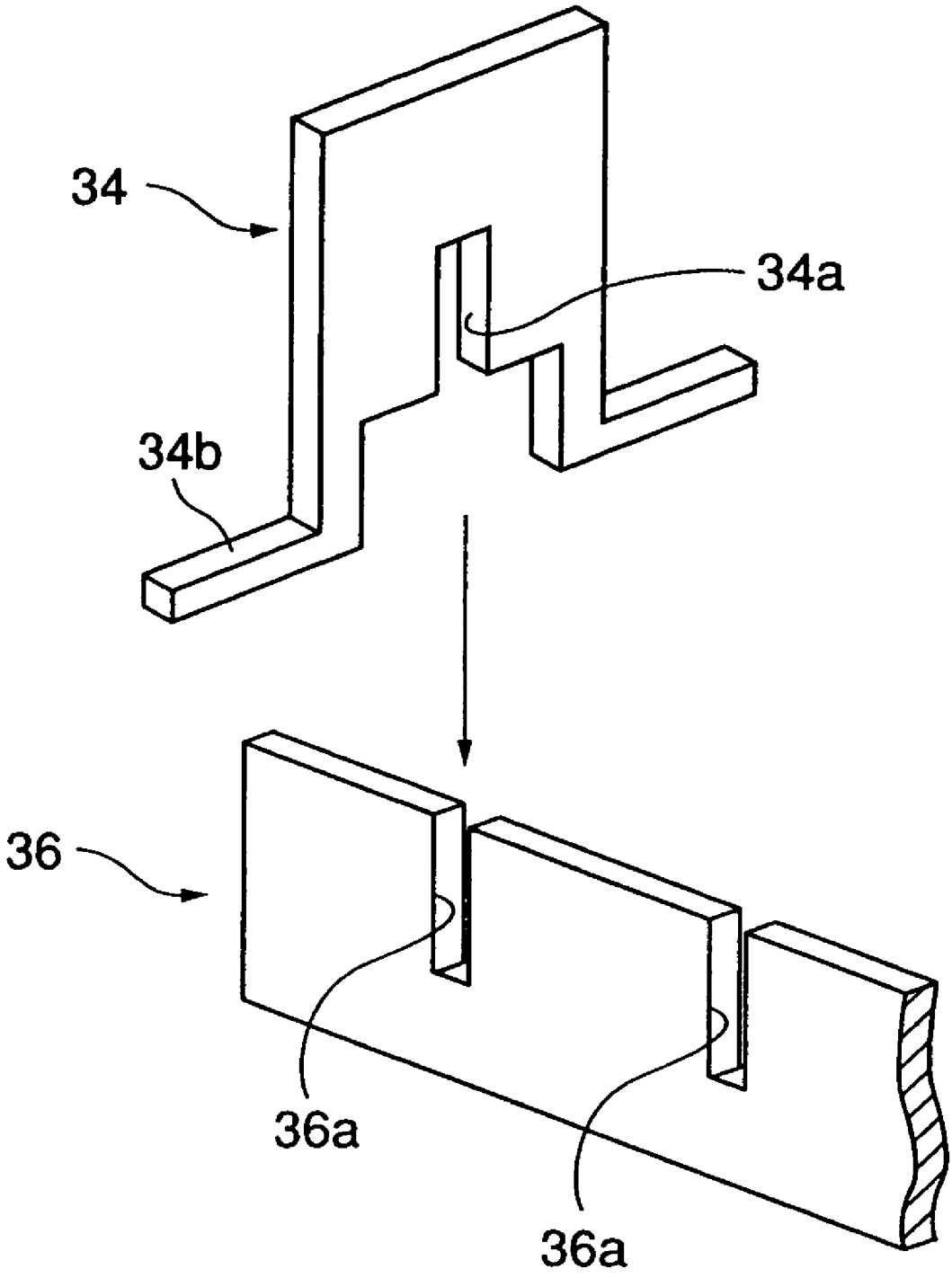
FIG. 4 is a perspective view of an array internal ground contact and an array intermediate ground contact of the plug connector of FIG. 2B.

As shown in FIG. 4, each of the array internal ground contacts 34 has a flat-panel shape with a step-like notch 34*a*. Each of the array internal ground contacts 34 also has lower ends 34*b* that bend and extend toward both sides. The array intermediate ground contacts 36 has a flat-panel shape, with slits 36*a* being formed at predetermined intervals.

The array intermediate ground contact 36 is positioned in the center of the concavity 38 of the housing 30 in the direction of Y1-Y2. The slits 36*a* of the array intermediate ground contact 36 are engaged with the notches 34*a*, so that the array internal ground contacts 34 are arranged perpendicularly to the array intermediate ground contact 36. Accordingly, the array intermediate ground contact 36 is electrically connected to the array internal ground contacts 34. Each of the array internal ground contacts 34 has the lower ends 34*b* extending outward from the bottom and the longitudinal side walls 30*b* and 30*c* of the housing 30 in the directions of Y1 and Y2.

As can be seen from FIG. 2B, the width W1 of each of the array internal ground contacts 34 is greater than the distance L1 between the two arrays of signal contacts 32*a* and 132*a* or signal contacts 32*b* and 132*b*. Accordingly, each pair of signal contacts 32*a* and 32*b* and each pair of signal contacts 132*a* and 132*b* are shielded from the neighboring pairs of signal contacts 32*a* and 32*b* and the neighboring pairs of signal contacts 132*a* and 132*b* by the array internal ground contacts 34 in the direction of X1-X2. Likewise, the width W2 of each divisional part of the array intermediate ground contact 36 divided by the array internal ground contacts 34 is greater than the distance L2 between each two paired signal contacts 32*a* and 32*b* or signal contacts 132*a* and 132*b*. Accordingly, each two neighboring pairs of signals contacts 32*a* and 32*b* and signal contacts 132*a* and 132*b* are completely shielded from each other by the array intermediate ground contact 36 in the direction of Y1-Y2.

FIG. 5 is a sectional view of the structure in which the signal contacts 32*a*, 32*b*, 132*a*, and 132*b*, the array internal ground contacts 34, and the array intermediate ground contact 36 are arranged in the housing 30. As can be seen from FIG. 5, a shielding layer 46 is provided on each inner surface of the longitudinal side walls 30*b* and 30*c* of the housing 30, and the lower end 46*a* of each shielding layer 46 penetrates through the bottom wall 30*a* of the housing 30.

The lower ends 32*a*-2, 32*b*-2, 132*a*-2, 132*b*-2, and 34*b* of the signal contacts 32*a*, 32*b*, 132*a*, 132*b*, and the array internal ground contacts 34 are joined to a pad (not shown) formed on a substrate 48, and are thus connected to a printed circuit (not shown) formed on the substrate 48. The lower end 46*a* of each shielding layer 46 is electrically connected to the ground (not shown) of the substrate 48.

Figure 6A:
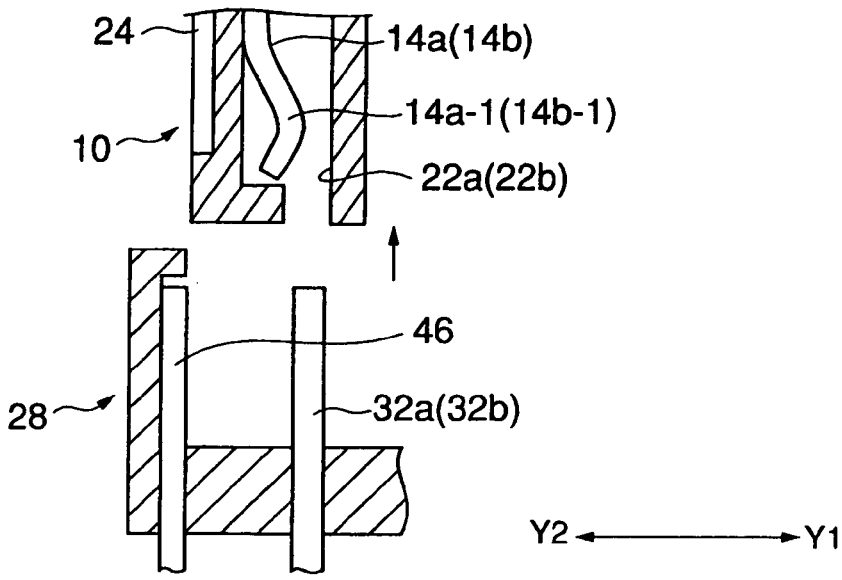
FIG. 6A illustrates a signal contact in the connection mechanism between the jack connector of FIG. 2A and the plug connector of FIG. 2B.
Figure 6B:
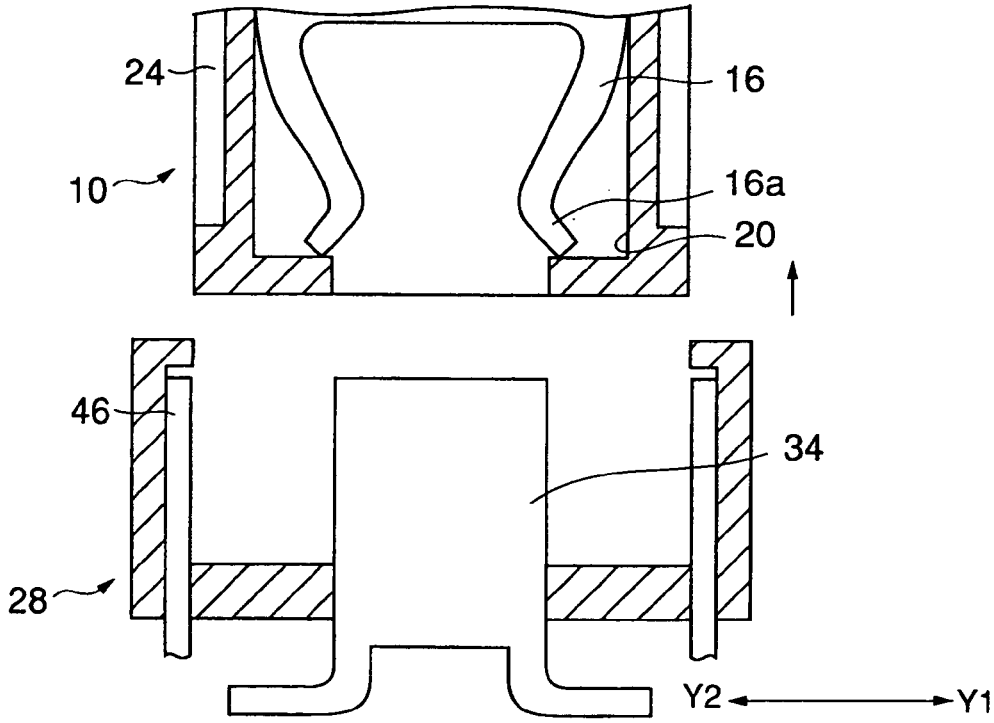
FIG. 6B illustrates ground contacts in the connection mechanism between the jack connector of FIG. 2A and the plug connector of FIG. 2B.

The connection mechanism of the above jack connector 10 and the plug connector 28 will be described below, with reference to FIGS. 6A and 6B. FIG. 6A illustrates only one of the arrays of signal contacts. FIG. 6B illustrates the ground contacts.

When the plug connector 28 is to be connected to the jack connector 10, the signal contacts 32*a* and 32*b* are inserted into the holes 22*a* and 22*b*, while pushing the upper ends 14*a*-1 and 14*b*-1 of the signal contacts 14*a* and 14*b* in the direction of Y2. By virtue of the restoring force of the signal contacts 14*a* and 14*b*, each signal contact 32*a* is brought into contact with each corresponding signal contact 14*a*, and each signal contact 32*b* is brought into each corresponding signal contact 14*b*.

As can be seen from FIG. 6B, each of the array internal ground contacts 34 is inserted into each corresponding slit 20, while pushing apart the upper ends 16*a* of each corresponding ground contact 16 in the directions of Y1 and Y2. By virtue of the restoring force of the ground contacts 16, each of the array internal ground contacts 34 is interposed between the upper ends 16*a* of each corresponding ground contact 16.

In this manner, it can be made sure that the signal contacts 14*a*, the signal contacts 14*b*, and the ground contacts 16 are electrically connected to the signal contacts 32*a*, the signal contacts 32*b*, and the array internal ground contacts 34, respectively. Likewise, it can be made sure that the signal contacts 114*a* and the signal contacts 114*b* are electrically connected to the signal contacts 132*a* and the signal contacts 132*b*, respectively. The shielding layers 24 are slidably in contact with the shielding layers 46, and are thus electrically connected to the shielding layers 46.

The substrate 26 to which the jack connector 10 is mounted is connected to the substrate 48 to which the plug connector 28 is mounted, with the jack connector 10 and the plug connector 28 being interposed in between. In this connected state, one of the substrates 26 and 48 is stacked on the other.

Each pair of signal contacts 14*a* and 14*b*, 114*a* and 114*b*, 32*a* and 32*b*, and 132*a* and 132*b*, is designed for balanced transmission. If a positive signal is transmitted through the signal contacts 14*a*, 114*a*, 32*a*, and 132*a*, a negative signal is transmitted through the signal contacts 14*b*, 114*b*, 32*b*, and 132*b*.

With the above plug connector 28 and the jack connector 10 in accordance with the first embodiment of the present invention, the wiring design and the wiring operation for the substrates are simple, because the lengths of each pair of wires for connecting the multiple pairs of signal contacts to a terminal unit can be made uniform in a case where the terminal unit located perpendicularly to the longitudinal direction of the housing is to be connected to signal contacts to mount the connector device onto the substrates. Also, noise can be prevented between signals subject to balanced transmission through each pair of signal contacts, and the characteristic impedance can be stabilized even in a high-speed signal transmitting operation.

Also, since an array internal ground contact is provided between each two neighboring pairs of signal contacts in plug connector 28 and the jack connector 10, crosstalk between each two neighboring pairs of signal contacts can be reduced. Particularly, the array internal ground contacts of the plug connector 28 are large enough to shield each pair of signal contacts from the neighboring pairs of signal contacts, and thus can effectively reduce crosstalk.

Further, with the array intermediate ground connector, the plug connector 28 can reduce crosstalk between the arrays of signal contacts. Also, with the shielding layers formed on the side walls of the housings, the plug connector 28 and the jack connector 10 can shield themselves from external electromagnetic waves.

Second Embodiment

Referring now to FIGS. 7A through 9, a connector in accordance with a second embodiment of the present invention will be described.

The connector in accordance with this embodiment includes a jack connector and a plug connector. Like the jack connector 10 and the plug connector 28 in the first embodiment, the jack connector and the plug connector are mounted on substrates, so as to connect multiple substrates. Although the connector in accordance with the first embodiment has a face-to-face connection mechanism in which the substrates are stacked on one another, the connector in accordance with the second embodiment described below has a horizontal connection mechanism in which the ends of substrates are connected to one another.

Figure 7A:
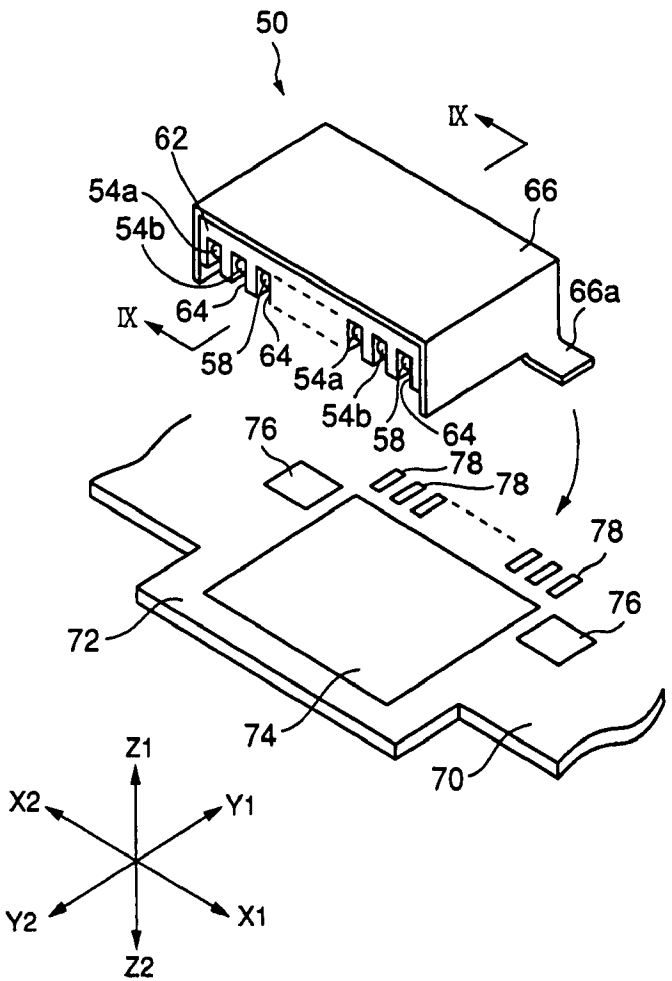
FIG. 7A is a perspective view of a jack connector in accordance with a second embodiment of the present invention.
Figure 7B:
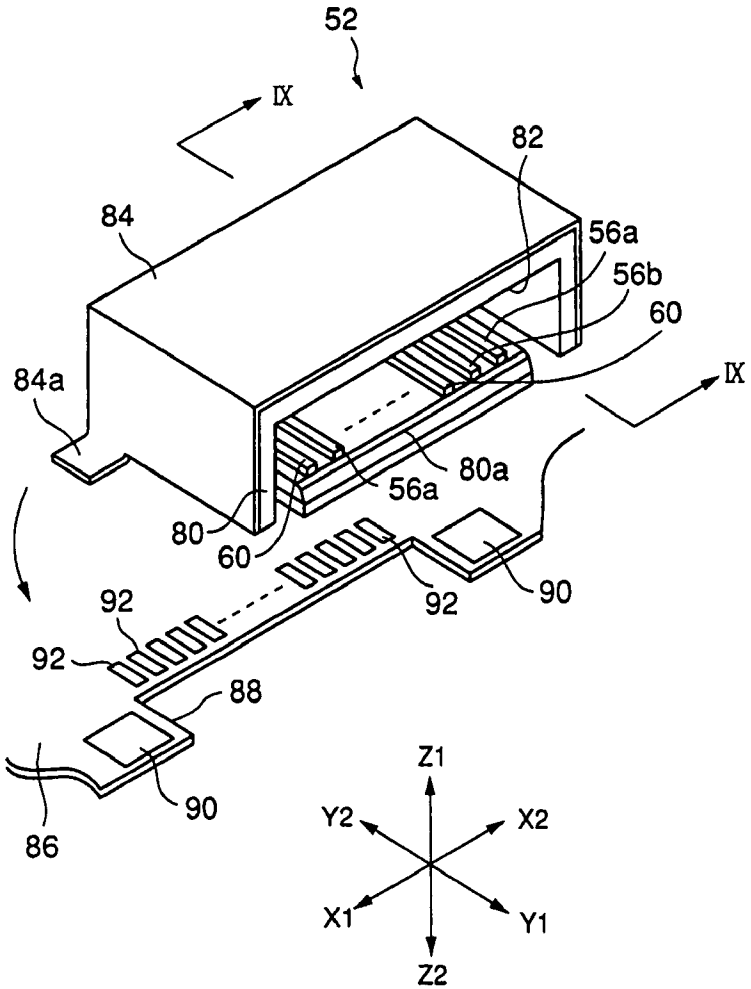
FIG. 7B is a perspective view of a plug connector in accordance with the second embodiment of the present invention.

As shown in FIGS. 7A and 7B, in a jack connector 50 and a plug connector 52, a pair of signal contacts 54*a* and 54*b* (hereinafter referred to simply as the "contacts") and a ground contact 58 (hereinafter referred to simply as the "contact") form a group, and a pair of signal contacts 56*a* and 56*b* (hereinafter referred to simply as the "contacts") and a ground contact 60 (hereinafter referred to simply as the "contact") form a group. In each of the connectors 50 and 52, multiple groups of signal contacts and ground contacts are aligned as one array. Each pair of signal contacts 54*a* and 54*b* and signal contacts 56*a* and 56*b* is designed for balanced transmission. If a positive signal is transmitted through the signal contacts 54*a* and 56*a*, a negative signal is transmitted through the signal contacts 54*b* and 56*b*.

The jack connector 50 will be described below in greater detail, followed by a detailed description of the plug connector 52.

The jack connector 50 has a housing 62 that is made of an insulating material. Multiple grooves 64 are formed in the lower half of the housing 62 on the side of Z2 in FIG. 7A. The housing 62 has side walls on the sides of X1-X2, the upper wall on the side of Z1, and the back wall on the side of Y1, which are covered with a metal plate 66. The metal plate 66 has protrusions 66*a* formed at the lower ends on both sides of X1-X2. The jack connector 50 does not require a bottom wall for the housing 62 on the side of Z2, and has a smaller height accordingly.

Figure 8A:
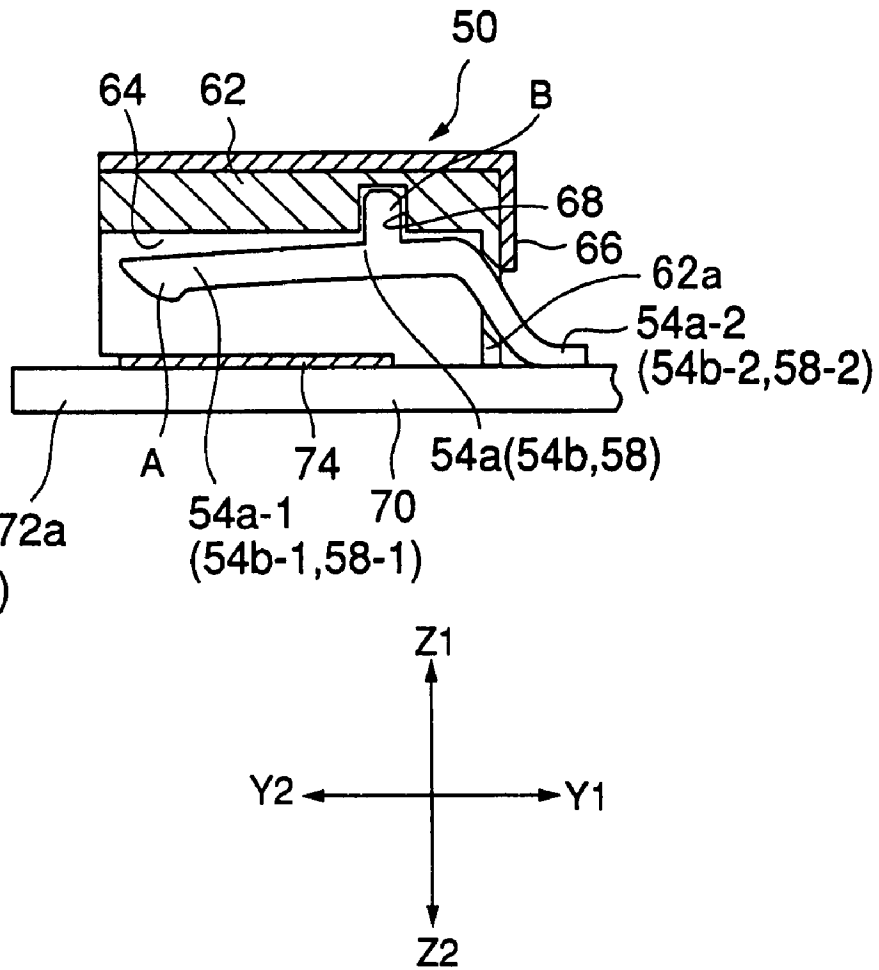
FIG. 8A is a sectional view of the jack connector, taken along the line IX—IX of FIG. 7A, and illustrates the situation immediately before the connecting process.
Figure 8B:
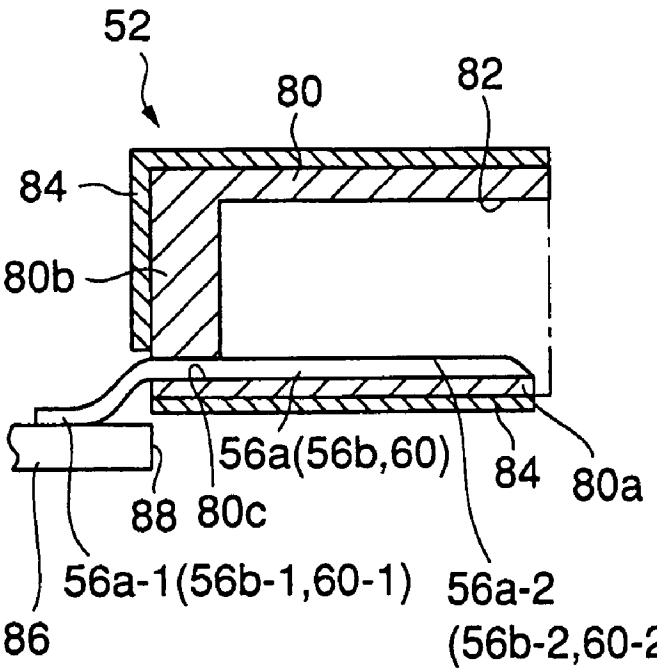
FIG. 8B is a sectional view of the plug connector, taken along the line IX—IX of FIG. 7B, and illustrates the situation immediately before the connecting process.

The contacts 54*a*, 54*b*, and 58 of the jack connector 50 have uniform stick-like shapes, as shown in FIGS. 8A and 8B. Each of the contacts 54*a*, 54*b*, and 58 is provided with a step-like part formed in its mid section. Each of the top ends 54*a*-1, 54*b*-1, and 58-1 of the contacts 54*a*, 54*b*, and 58 on the side of Y2 of FIGS. 7A and 7B and FIG. 8A, has a protrusion A at the top facing inward. Also, a protrusion B extending in the direction of Z1 is provided between the mid section and each of the top ends 54*a*-1, 54*b*-1, and 58-1. Each of the back ends 54*a*-2, 54*b*-2, and 58-2 of the contacts has a tongue-like shape.

The protrusions B are engaged with concavities 68 formed in the upper walls of the grooves 64 of the housing 62, so that the contacts 54*a*, 54*b*, and 58 are fixed to the housing 62. As there is no need to have the back wall 62*a* used for fixing the contacts 54*a*, 54*b*, and 58, the back wall 62*a* is made thin. As a result, the depth W3 of the jack connector 50 is smaller (see FIG. 9). In the connected state with the plug connector 52 that will be described later, the contacts 54*a*, 54*b*, and 58 are fixed to the housing 62 through the engagement of the protrusions B extending in the direction (of Z1) perpendicular to the connecting direction (Y1-Y2) of the contacts 54*a*, 54*b*, and 58 with the concavities 68. In this structure, the contacts 54*a*, 54*b*, and 58 cannot be pulled off, when the plug connector 52 is attached to or detached from the jack connector 50.

The groups each consisting of a pair of signal contacts 54*a* and 54*b* and one ground contact 58 are set in the grooves 64 of the housing 62.

A substrate 70 onto which the jack connector 50 is to be mounted has a protruding part 72 in the mid section on the side of Y2, as shown in FIG. 7A. A wide pad (pattern) 74 is formed on the Y1 side of the protruding part 72. A pair of pads 76 is formed on both X1-X2 sides of the pad 74, and multiple pads 78 are arranged on the Y1 side of the pad 74.

The jack connector 50 is placed on the substrate 70, and the protrusions 66*a* of the metal plate 66 are joined to the pads 76, so that the metal plate 66 and the housing 62 held by the metal plate 66 are fixed to the substrate 70. Meanwhile, the back ends 54*a*-2, 54*b*-2, and 58-2 of the contacts 54*a*, 54*b*, and 58 of the jack connector 50 are joined to the pads 78, so that the contacts 54*a*, 54*b*, and 58 are connected to a wiring pattern (not shown) formed on the substrate 70. The other ends of the wires connected to the signal contacts 54*a* and 54*b* are connected to a terminal unit or the like (not shown) provided on the Y1 side. The other ends of the wires connected to the ground contacts 58 are connected to a ground unit (not shown) provided on the Y1 side.

The plug connector 52 has a housing 80 that is made of an insulating material. The housing 80 has a concavity 82 formed longitudinally in the direction of X1-X2 of FIG. 7B. The bottom wall 80*a* of the housing 80 has notches at both ends in the direction of X1-X2. The entire housing 80 is covered with a metal plate 84, except the opening on the Y1 side. The metal plate 84 has protrusions 84*a* at both lower ends in the direction of X1-X2.

The contacts 56*a*, 56*b*, and 60 of the plug connector 52 have uniform stick-like shapes, as shown in FIG. 8B. Each of the contacts 56*a*, 56*b*, and 60 has a step-like part formed in its mid section. Each of the back ends 56*a*-2, 56*b*-2, and 60-2 has a tongue-like shape.

The top ends 56*a*-2, 56*b*-2, and 60-2 are pushed in the direction of Y1 and penetrate through holes 80*c* formed in the back wall 80*b* of the housing 80, so that the contacts 56*a*, 56*b*, and 60 of the plug connector 52 are fixed to the housing 80. The pairs of signal contacts 56*a* and 56*b* and the ground contacts 60 are alternately arranged on the bottom wall 80*a* of the housing 80.

A substrate 86 onto which the plug connector 52 is to be mounted has a wide notch 88 in the mid section of the side of Y1. A pair of pads 90 is formed on both X1-X2 sides of the notch 88. Also, multiple pads 92 are arranged on the Y2 side of the notch 88.

The plug connector 52 is placed on the substrate 86, and the protrusions 84*a* of the metal plate 84 are joined to the pads 90, so that the metal plate 84 and the housing 80 held by the metal plate 84 are fixed to the substrate 86. Meanwhile, the back ends 56*a*-1, 56*b*-1, and 60-1 of the contacts 56*a*, 56*b*, and 60 of the plug connector 52 are joined to the pads 92, so that the contacts 56*a*, 56*b*, and 60 are connected to a wiring pattern (not shown) formed on the substrate 86. The other ends of the wires connected to the signal contacts 56*a* and 56*b* are connected to a terminal unit or the like (not shown) provided on the Y2 side. The other ends of the wires connected to the ground contacts 60 are connected to a ground unit (not shown) provided on the Y2 side.

Figure 9:
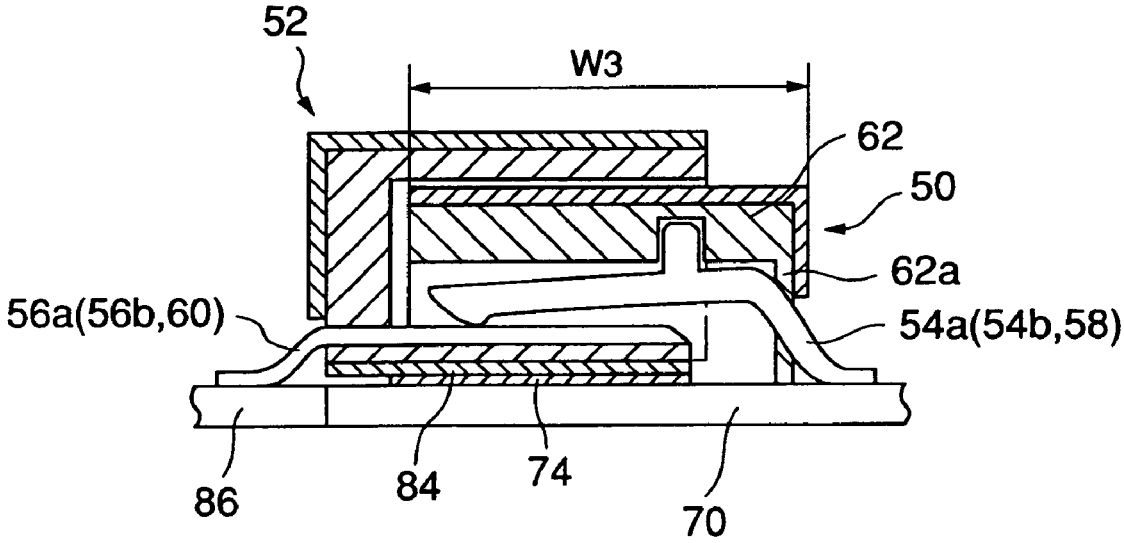
FIG. 9 is a sectional view illustrating the connection mechanism between the jack connector and the plug connector in a connected state, taken along the line IX—IX of FIGS. 7A and 7B.

The connection mechanism of the above jack connector 50 and the plug connector 52 will be described below, with reference to FIGS. 8A and 8B and FIG. 9.

The protruding part 72 of the substrate 70 onto which the jack connector 50 is mounted is engaged with the notch 88 of the substrate 86 onto which the plug connector 52 is mounted, so that the plug connector 52 is connected to the jack connector 50. Here, the upper surfaces of the contacts 56*a*, 56*b*, and 60 are slid along the contacts 54*a*, 54*b*, and 58, with the bottom wall 80*a* of the plug connector 52 being sandwiched between the pad 74 and the contacts 54*a*, 54*b*, and 58 of the jack connector 50. By doing so, the protrusions A are pushed in the direction of Z1, and, by virtue of the restoring force of the top ends 54*a*-1, 54*b*-1, and 58-1 of the contacts 54*a*, 54*b*, and 58, the contacts 56*a*, 56*b*, and 60 are brought into close contact with the contacts 54*a*, 54*b*, and 58. The signal contacts 54*a*, the signal contacts 54*b*, and the ground contacts 58 are thus electrically connected to the signal contacts 56*a*, the signal contacts 56*b*, and the ground contacts 60, respectively. Meanwhile, the metal plate 84 under the lower surface of the bottom wall 80*a* of the plug connector 52 is brought into contact with the pad 74 of the jack connector 50, so that the metal plate 84 is electrically connected to the pad 74.

In this manner, the substrate 70 to which the jack connector 50 is mounted and the substrate 86 to which the plug connector 52 is mounted are horizontally connected to each other via the jack connector 50 and the plug connector 52.

With the above plug connector 52 and the jack connector 50 in accordance with the second embodiment of the present invention, the wiring design and the wiring operation are simplified, because the lengths of the wires that connect the pairs of signal contacts and a terminal unit or the like can be made uniform in a case where the terminal unit or the like located perpendicularly to the longitudinal direction of the housing is to be connected to the signal contacts so as to mount the connectors onto the substrates. Also, noise can be prevented in signals subject to balance transmission through each pair of signal contacts, and the characteristic impedance can be stabilized even in a high-speed signal transmitting operation.

Furthermore, as the metal plates that serve as shielding layers are provided on the exteriors of the housings, the plug connector 52 and the jack connector 50 can shield themselves from external electromagnetic waves. When the plug connector 52 is attached to or detached from the jack connector 50, the contact force of the contacts of both connectors expands the housings, but the expansion of the housings can be restricted by the metal plates covering the housings.

Since the attachment of the plug connector 52 to the substrate 86 and the attachment of the jack connector 50 to the substrate 70 are carried out only through the protrusions of the metal plates and the back ends of the contacts, the number of soldered points is small, and the soldering operation can be efficiently carried out. Also, as the contacts are formed like sticks by plate-stamping with excellent dimensional precision, the contact surfaces have excellent plane-dimensional precision.

Third Embodiment

A connector in accordance with a third embodiment of the present invention will be next described.

Figure 10A:
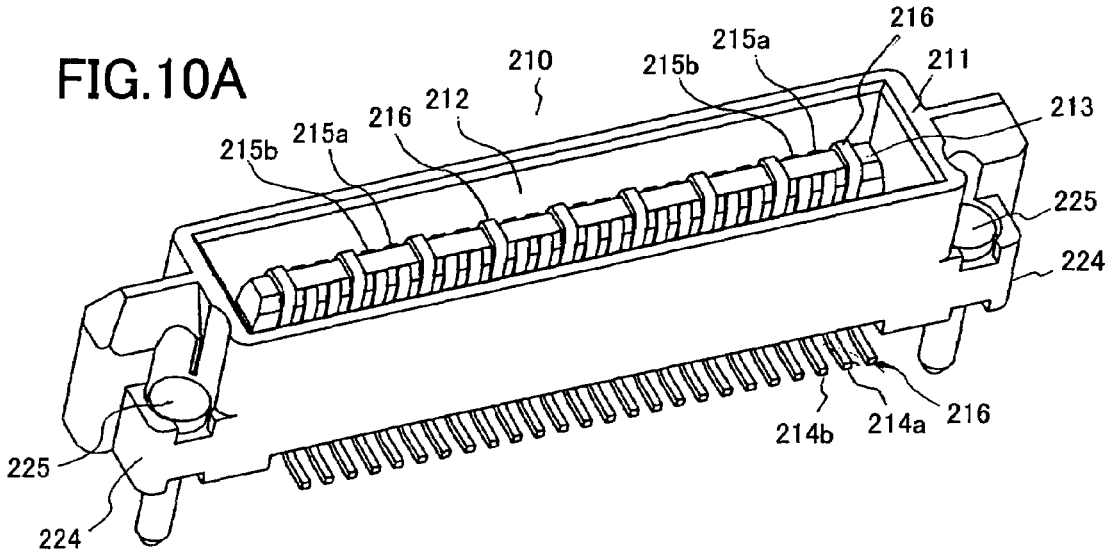
FIG. 10A is a perspective view of a plug connector in accordance with a third embodiment of the present invention.

FIGS. 10A through 10D illustrate a plug connector 210 in accordance with the third embodiment. More specifically, FIG. 10A is a perspective view of the connector 210, FIG.

Figure 10B:
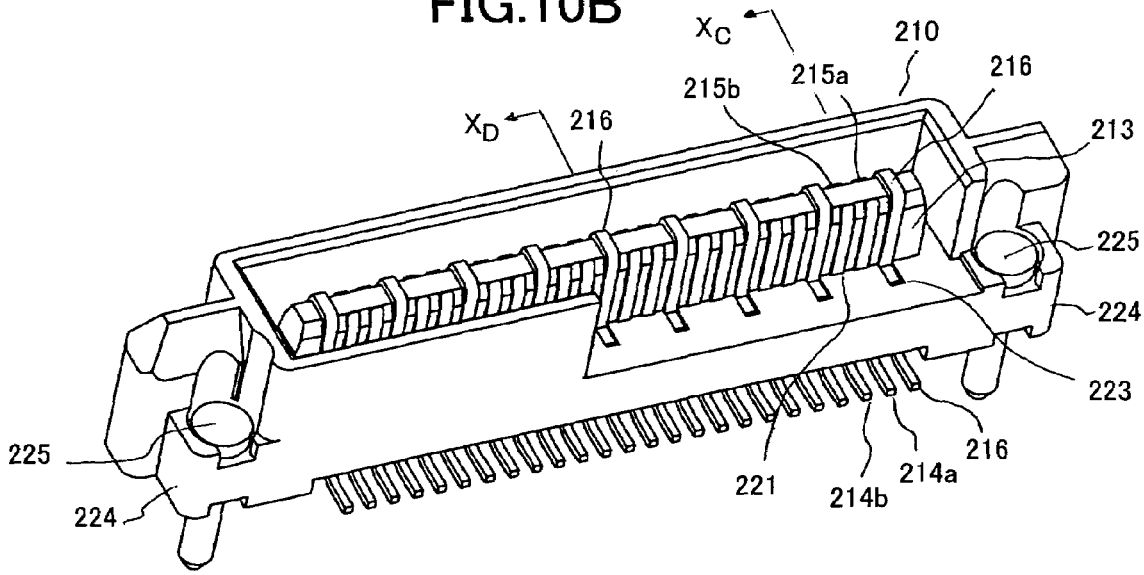
FIG. 10B is a partially cutaway perspective view of the plug connector in accordance with the third embodiment of the present invention.
Figure 10C:
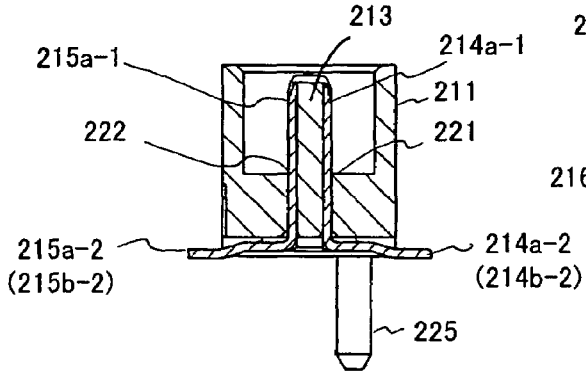
FIG. 10C is a sectional view of the plug connector, taken along the line $X_C$ of FIG. 10B.
Figure 10D:
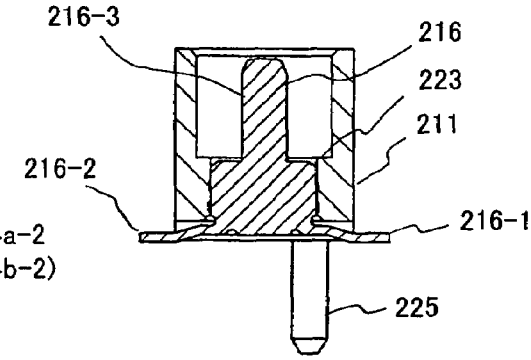
FIG. 10D is a sectional view of the plug connector, taken along the line $X_D$ of FIG. 10B.

10B is a partially cutaway perspective view of the connector 210, FIG. 10C is a sectional view of the connector 210 taken along the line $X_C$ of FIG. 10B, and FIG. 10D is a sectional view of the connector 210 taken along the line $X_D$ of FIG. 10B.

The connector 210 includes a housing 211 having a concavity 212. The housing 211 is made of an insulating material such as polyester or LCP (Liquid Crystal Polymer) resin. A contact supporting member 213 extending in the longitudinal direction of the connector 210 is provided in the concavity 212. The contact supporting member 213 may be integrally formed with the housing 211, and is shaped like a flat panel. The contact supporting member 213 has two planes facing each other, and signal contacts 214*a*, 214*b*, 215*a*, and 215*b* of uniform lengths are arranged on the two planes. Each one signal contact 214*a* is paired with one signal contact 214*b*, and each pair of signal contacts 214*a* and 214*b* is designed for balanced transmission of signals at a speed of 1 Gbit/s or higher. Accordingly, each pair of signal contacts 214*a* and 214*b* transmits signals of the same sizes and the opposite polarities. The pairs of signal contacts are adjacent to one another over the entire length, and are uniformly arranged. Also, the pairs of signal contacts 214*a* and 214*b* are in parallel with one another over the entire length, and are aligned at uniform intervals. Accordingly, excellent coupling can be established over the entire length of each of the signal contacts, unlike the prior art in which coupling cannot be established among some of the signal contacts.

The multiple pairs of signal contacts 214*a* and 214*b* are arranged as one array at uniform intervals in the longitudinal direction of the housing 211. Likewise, each one signal contact 215*a* is paired with one signal contact 215*b*, and each pair of signal contacts 215*a* and 215*b* is designed for balanced transmission. Multiple pairs of signal contacts 215*a* and 215*b* are arranged in parallel with one another on the other plane of the contact supporting member 213. In other words, the signal contacts 215*a* and 215*b* are arranged as one array at uniform intervals in the longitudinal direction of the housing 211. Accordingly, the connector 210 has a two-array structure that includes the array of the signal contacts 214*a* and 214*b* and the array of the signal contacts 215*a* and 215*b*.

The signal contacts 214*a*, 214*b*, 215*a*, and 215*b* are made of a single material, and have thin and long shapes (pin-like shapes) of uniform lengths. For instance, the signal contacts 214*a*, 214*b*, 215*a*, and 215*b* can be formed by stamping out a gold-plated flat plate of a copper alloy and then bending the stampedout parts.

Rectangular holes 223 are formed in the contact supporting member 213 and the bottom part of the housing 211, and ground contacts 216 are arranged in the rectangular holes 223. The ground contacts 216 divide the array of the signal contacts 214*a* and 214*b* into multiple pairs of signal contacts, and also divide the array of the signal contacts 215*a* and 215*b* into multiple pairs of signal contacts. Accordingly, between each two neighboring ground contacts 216, there exist a pair of signal contacts 214*a* and 214*b* of one array and a pair of signal contacts 215*a* and 215*b* of the other array.

As shown in FIG. 10C, each of the signal contacts 214*a* has a connector contact part 214*a*-1 to be connected to the corresponding contact of a mating connector, and a substrate contact part 214*a*-2 formed integrally with the connector contact part 214*a*-1. Each connector contact part 214*a*-1 penetrates through each corresponding hole 221 formed in the housing 211, and extends along one of the two planes of the contact supporting member 213. Each substrate contact part 214*a*-2 is bent at approximately 90 degrees with respect to each corresponding connector contact part 214*a*-1, and extends in such a manner as to be connected to a connecting terminal such as a pad provided on a mounting surface of a printed circuit board (not shown) Each of the contacts 215*a* on the opposite side of the contact supporting member 213 from the contacts 214*a* also has a connector contact part 215*a*-1 to be connected to the corresponding contact of a mating connector, and a substrate contact part 215*a*-2 formed integrally with the connector contact part 215*a*-1. Each connector contact part 215*a*-1 penetrates through each corresponding hole 222 formed in the housing 211, and extends along the other plane of the contact supporting member 213. Each substrate contact part 215*a*-2 is bent at approximately 90 degrees with respect to each corresponding connector contact part 215*a*-1, and extends in such a manner as to be connected to a connection terminal such as a pad provided on a mounting surface of a printed circuit board. The substrate contacts 214*a*-2 and 215*a*-2 extend in the opposite directions. The signal contacts 214*b* are formed in the same manner as the signal contacts 214*a*, and the signal contacts 215*b* are formed in the same manner as the signal contacts 215*a*. Accordingly, each pair of substrate contact parts 214*a*-2 and 214*b*-2 extends in a first direction (from one side of the housing 211), while each pair of substrate contact parts 215*a*-2 and 215*b*-2 extends in a second direction (from the other side of the housing 211) that is the opposite of the first direction.

As shown in FIG. 10D, each of the ground contacts 216 has two substrate contact parts 216-1 and 216-2, and a plate-like part 216-3 formed integrally with the two substrate contact parts 216-1 and 216-2. The ground contacts 216 are arranged in both two arrays of signal contacts. The plate-like part 216-3 of each ground contact 216 penetrates through the corresponding rectangular hole 223 formed in the housing 211 and the contact supporting member 213, and extends in the vertical direction. The top of each plate-like part 216-3 protrudes from the upper surface of the contact supporting member 213. Accordingly, the ground contacts 216 may be taller than or as tall as the signal contacts 214*a*, 214*b*, 215*a*, and 215*b*. To effectively shield each pair of signal contacts from the neighboring pairs, the width of each plate-like part 216-3 is greater than the distance between each two adjacent signal contacts 214*a* (214*b*) and 215*a* (215*b*). The substrate contact part 216-1 of each ground contact 216 extends in such a manner as to be connected to a connection terminal such as a pad provided on a mounting surface. The substrate contact parts 216-1 are on the same level (an even level without a step) as the substrate contact parts 214*a*-2 of the signal contacts 214*a*, and also extend in the same direction as the substrate contact parts 214*a*-2 of the signal contacts 214*a*. The other substrate contact part 216-2 of each ground contact 216 is formed in the same manner as the above. The substrate contact parts 216-1 and 216-2 extend in the opposite directions.

In this structure, an array of multiple pairs of substrate contact parts 214*a*-2 and 214*b*-2, with a substrate ground contact part 216-1 being interposed between each two neighboring pairs, and an array of multiple pairs of substrate contact parts 215*a*-2 and 215*b*-2, with a substrate ground contact part 216-2 being interposed between each two neighboring pairs, are formed on the side of a wiring substrate. The two arrays of substrate contact parts exist on the same level, and extend in the opposite directions. The substrate contact parts 214*a*-2, 214*b*-2, and the substrate ground contact parts 216-1, are aligned at uniform intervals.

Protruding parts 224 are formed at the left and right sides of the housing 211, and cylindrical fixing members 225 are inserted into holes formed in the protruding parts 224. Each of the fixing members 225 is inserted into each corresponding through hole formed in the wiring substrate, and is then fixed by soldering. Thus, the connector 210 can be mounted and fixed to the wiring substrate.

The substrate contact parts 214*a*-2 and 214*b*-2 in each pair extend in parallel with each other and have the same lengths, so that signals can travel in balanced transmission in the same phase on the wiring substrate. Likewise, the substrate contact parts 215*a*-2 and 215*b*-2 in each pair expend in parallel with each other and have the same lengths, so that signals can be transmitted in the balanced state in the same phase on the wiring substrate. As a result, noise that was caused by a phase difference in the prior art can be prevented, and the characteristic impedance can be stabilized. Also, the substrate contact parts 214*a*-2 and 214*b*-2 are adjacent to one another, and the substrate contact parts 215*a*-2 and 215*b*-2 are also adjacent to one another. Thus, the lengths of each pair of wires on the wiring substrate can be easily made uniform, and the wiring design and the wiring operation for the wiring substrate can be readily simplified. Furthermore, even in the two-array structure, the pairs of signal contacts are adjacent to one another over the entire length. Accordingly, excellent high-density balanced transmission can be realized.

The pairs of signal contacts adjacent to one another in the longitudinal direction of the connector 210 are electrically shielded from one another by the ground contacts 216, and accordingly, there is no interference between each two neighboring pairs of signal contacts in each array. Meanwhile, each pair of signal contacts 214*a* and 214*b* faces each corresponding pair of signal contacts 215*a* and 215*b* via the contact supporting member 213 made of an insulating material, and any shielding member like the array intermediate ground contact 36 of the first embodiment is not employed in this embodiment. Accordingly, compared with the first embodiment, there is a greater possibility that phase difference is caused between the arrays of signal contacts facing each other via the contact supporting member 213, and noise is then generated. However, chances are that there will be no problems in practice, as long as the distance between each pair of signal contacts 214*a* and 214*b* and the distance between each pair of signal contacts 215*a* and 215*b* are shorter than the diagonal distance between each two opposite signal contacts 214*a* and 215*b* and the diagonal distance between each two opposite signal contacts 214*b* and 215*a*, respectively. Since a shielding member like the array intermediate ground contact 36 of the first embodiment is not employed, this embodiment has an advantage of reducing the production costs of the connector requiring a smaller number of components.

Figure 11A:
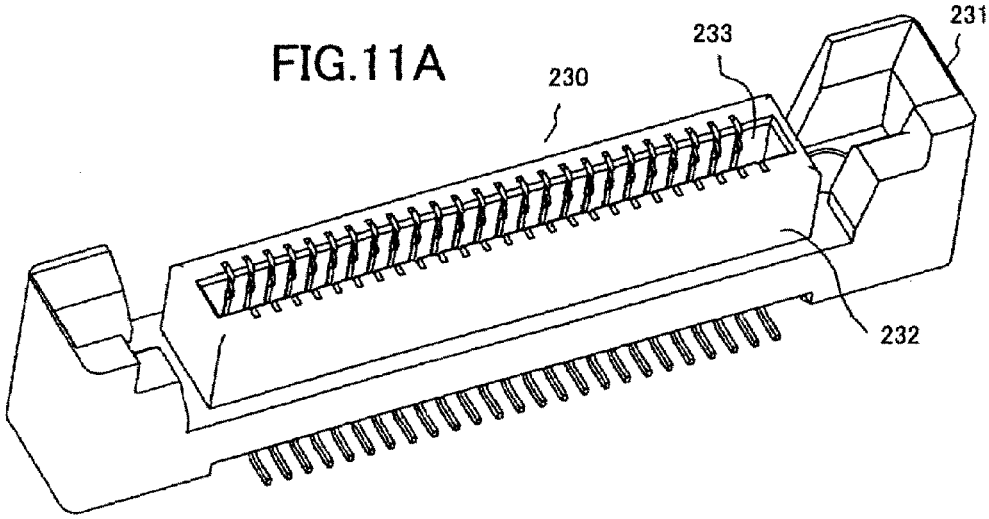
FIG. 11A is a perspective view of a jack connector in accordance with the third embodiment of the present invention.
Figure 11B:
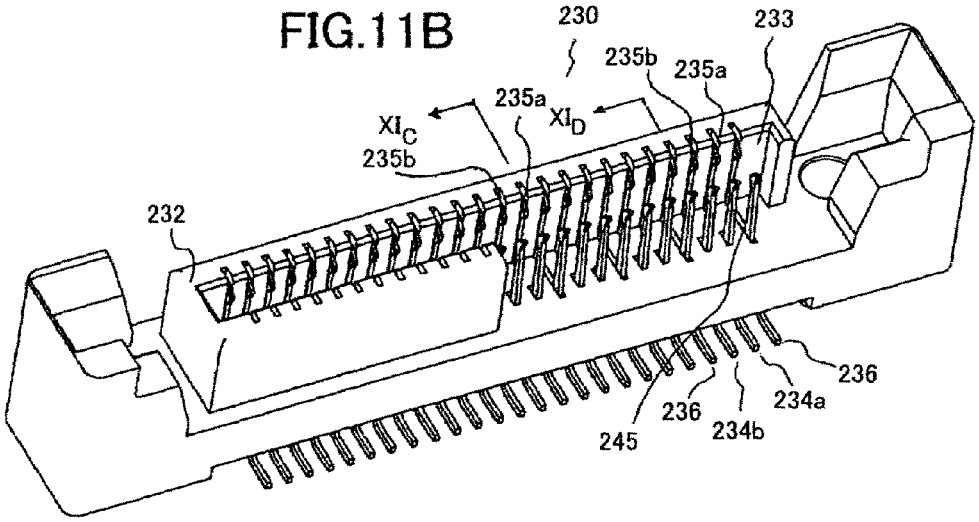
FIG. 11B is a partially cutaway perspective view of the jack connector in accordance with the third embodiment of the present invention.
Figure 11C:
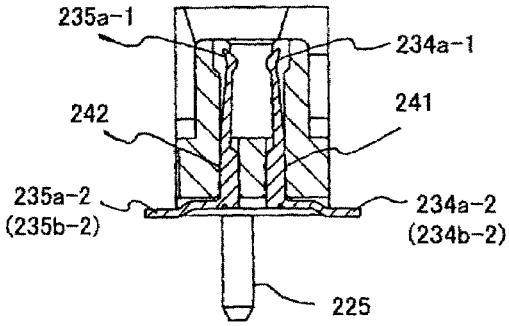
FIG. 11C is a sectional view of the jack connector, taken along the line $XI_C$ of FIG. 11B.
Figure 11D:
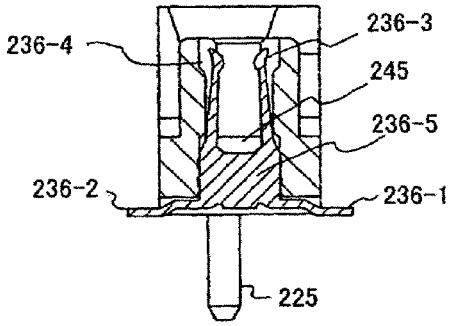
FIG. 11D is a sectional view of the jack connector, taken along the line $XI_D$ of FIG. 11B.

Referring next to FIGS. 11A through 11D, a jack connector 230 in accordance with the third embodiment of the present invention will be described. FIG. 11A is a perspective view of the connector 230, FIG. 11B is a partially cutaway perspective view of the connector 230, FIG. 11C is a sectional view of the connector 230 taken along the line $XI_C$ of FIG. 11B, and FIG. 11D is a sectional view of the connector 230 taken along the line $XI_D$ of FIG. 11B. The jack connector 230 is to be paired with the plug connector 210.

The connector 230 includes a housing 231 having a convexity 232. The housing 231 is made of an insulating material such as polyester or liquid crystal polymer resin. The convexity 232 extends in the longitudinal direction of the connector 230, and has a concavity 233. The contact supporting member 213 of the connector 210 is to be inserted into the concavity 233. In the concavity 233, two arrays of signal contacts and ground contacts are arranged. One of the arrays includes signal contacts 234*a* and 234*b* of uniform lengths, and the other array includes signal contacts 235*a* and 235*b* having the same lengths as the signal contacts 234*a* and 234*b*. Each one signal contact 234*a* is paired with one signal contact 234*b*, and each pair of signal contacts 234*a* and 234*b* is designed for balanced transmission of signals at a speed of 1 Gbit/s or higher.

The pairs of signal contacts 234*a* and 234*b* are adjacent to one another over the entire length, and are uniformly arranged. Also, the pairs of signal contacts 234*a* and 234*b* extend in parallel with one another over the entire length, and are aligned at uniform intervals. Accordingly, excellent coupling can be established over the entire length of the signal contacts 234*a* and 234*b*.

The multiple pairs of signal contacts 234*a* and 234*b* are arranged in parallel with one another at intervals, and constitute one of the two arrays. Likewise, each one signal contact 235*a* is paired with one signal contact 235*b*, and each pair of signal contacts 235*a* and 235*b* is designed for balanced transmission. The multiple pairs of signal contacts 235*a* and 235*b* are arranged in parallel with one another at intervals, and constitute the other array. Accordingly, the connector 230 includes the signal contacts 234*a*, 234*b*, 235*a*, and 235*b* that are arranged in the two arrays.

The signal contacts 234*a*, 234*b*, 235*a*, and 235*b* are made of a single material, and have thin and long shapes (pin-like shapes) of uniform lengths. For instance, the signal contacts 234*a*, 234*b*, 235*a*, and 235*b* can be formed by stamping out a gold-plated flat plate of a copper alloy and then bending the stamped-out parts.

Rectangular holes 245 are formed in the bottom part of the housing 231, and ground contacts 236 are arranged in the rectangular holes 245. The ground contacts 236 divide the array of the signal contacts 234*a* and 234*b* into multiple pairs of signal contacts, and also divide the array of the signal contacts 235*a* and 235*b* into multiple pairs of signal contacts. Accordingly, between each two neighboring ground contacts 236, there exist a pair of signal contacts 234*a* and 234*b* of one array and a pair of signal contacts 235*a* and 235*b* of the other array.

As shown in FIG. 11C, each of the signal contacts 234*a* is a single member that has a connector contact part 234*a*-1 to be connected to the corresponding connector contact part 214*a*-1 of the plug connector 210, and a substrate contact part 234*a*-2. Each connector contact part 234*a*-1 penetrates through each corresponding hole 241 formed in the housing 231, and extends along the inside of the concavity 233. With the connector 230 being mounted onto a wiring substrate, each connector contact part 234*a*-1 extends perpendicularly to the wiring substrate. Each substrate contact part 234*a*-2 is bent at approximately 90 degrees with respect to each corresponding connector contact part 234*a*-1, and extends in such a manner as to be connected to a connecting terminal such as a pad provided on a mounting surface of a printed circuit board (not shown). Each of the contacts 235*a* facing the contacts 214*a* via a space also has a connector contact part 235*a*-1 to be connected to the corresponding connector contact 215*a*-1 of the plug connector 210, and a substrate contact part 235*a*-2 formed integrally with the connector contact part 235*a*-1. Each connector contact part 235*a*-1 penetrates through each corresponding hole 242 formed in the housing 231, and extends along the inside of the concavity 233. Each substrate contact part 235*a*-2 is bent at approximately 90 degrees with respect to each corresponding connector contact part 235*a*-1, and extends in such a manner as to be connected to a connection terminal such as a pad provided on a mounting surface of a printed circuit board. The substrate contacts 234*a*-2 and 235*a*-2 extend in the opposite directions. The signal contacts 234*b* are formed in the same manner as the signal contacts 234*a*, and the signal contacts 235*b* are formed in the same manner as the signal contacts 235*a*. Each of the connector contact parts 234*a*-1, 234*b*-1, 235*a*-1, and 235*b*-1 has an inward protrusion like the protrusion A, and is tilted inward so as to provide spring tension. When the plug connector 210 is attached to the jack connector 230, the connector contact parts 214*a*-1, 214*b*-1 215*a*-1, and 215*b*-1 of the plug connector 210 are engaged with the corresponding connector contact parts 234*a*-1, 234*b*-1, 235*a*-1, and 235*b*-1, and the inward protrusions pushes outward the connector contact parts 214*a*-1, 214*b*-1 215*a*-1, and 215*b*-1. By virtue of the spring restoring force of the connector contact parts 234*a*-1, 234*b*-1, 235*a*-1, and 235*b*-1, electric connection can be surely established.

Figures 1A, 1B:
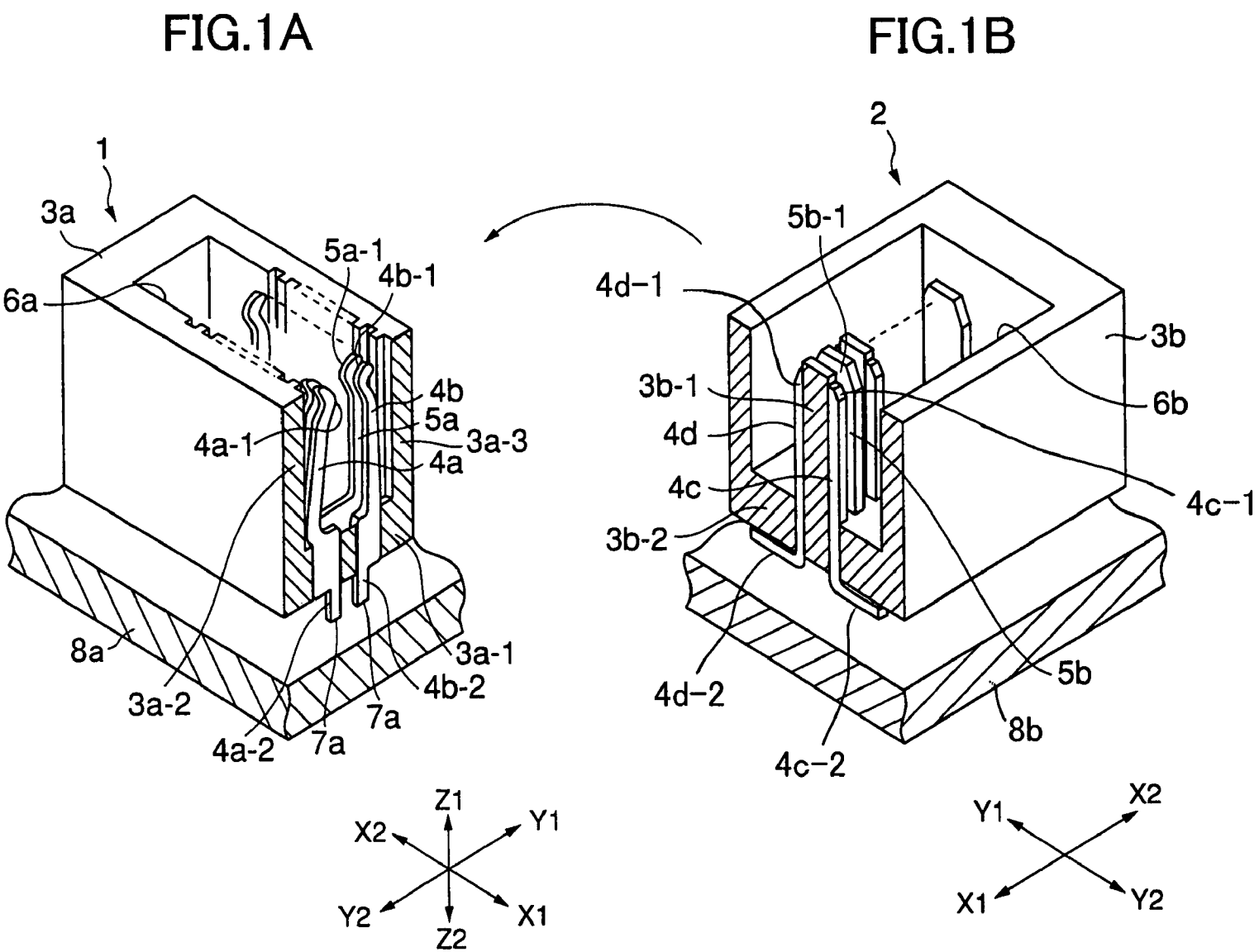
FIG. 1A is a perspective view of a jack connector that is a part of a conventional connector device.
FIG. 1B is a perspective view of a plug connector that is a part of the conventional connector device.

As shown in FIG. 1D, each of the ground contacts 236 has two substrate contact parts 236-1 and 236-2, two connector contact parts 236-3 and 236-4, and a base part 236-5. Each of the contact parts 236-1 through 236-4 and the base parts 236-5 is a single member that may be formed by stamping out a gold-plated flat panel of a copper alloy and then bending the stamped-out part. Each of the connector contact parts 236-3 and 236-4 penetrates through each corresponding hole 241 formed in the housing 231, and extends along the inside of the concavity 233. Each two adjacent connector contact parts 236-3 and 236-4 face each other via a space. Each of the connector contact parts 236-3 and 346-4 has an inward protrusion, and is tilted inward so as to provide spring tension. In other words, the connector contact parts 236-3 and 236-4 are the same as the connector contact parts 234*a*-1 and 235*a*-1 shown in FIG. 11C. When the plug connector 210 is attached to the jack connector 230, the protrusions of the connector contact parts 236-3 and 236-4 are engaged with the corresponding ground contacts 216 of the plug connector 210, and pushes these connector contact parts outward. Thus, electric connection can be surely established by virtue of the restoring force. The substrate contact parts 236-1 and 236-2 are bent outward at approximately 90 degrees with respect to the base parts 236-5, and extend in the opposite directions.

In this structure, an array of multiple pairs of substrate contact parts 234*a*-2 and 234*b*-2, with a substrate ground contact part 236-1 being interposed between each two neighboring pairs, and an array of multiple pairs of substrate contact parts 235*a*-2 and 235*b*-2, with a substrate ground contact part 236-2 being interposed between each two neighboring pairs, are formed on the side of the wiring substrate. The two arrays of substrate contact parts exist on the same level, and extend in the opposite directions. The substrate contact parts 234*a*-2, 234*b*-2, and the substrate ground contact parts 236-1, are aligned at uniform intervals, and so are the substrate contact parts 235*a*-2, 235*b*-2, and the substrate ground contact parts 236-2.

The substrate contact parts 234*a*-2 and 234*b*-2 in each pair extend in parallel with each other and have the same lengths, so that signals can be transmitted in the balanced state in the same phase on the wiring substrate. Likewise, the substrate contact parts 235*a*-2 and 235*b*-2 in each pair expend in parallel with each other and have the same lengths, so that signals can be balanced-transmitted in the same phase on the wiring substrate. As a result, noise that was caused by a phase difference in the prior art can be prevented, and the characteristic impedance can be stabilized. Also, the substrate contact parts 234*a*-2 and 234*b*-2 are adjacent to one another, and the substrate contact parts 235*a*-2 and 235*b*-2 are also adjacent to one another. Thus, the lengths of each pair of wires on the wiring substrate can be easily made uniform, and the wiring design and the wiring operation for the wiring substrate can be readily simplified. Furthermore, even in the two-array structure, the pairs of signal contacts are adjacent to one another over the entire length. Accordingly, excellent high-density balanced transmission can be realized.

When the jack connector 230 and the plug connector 210 are connected to each other, the ground contacts 216 of the plug connector 210 are inserted between the pairs of signal contacts adjacent to one another in the array direction of the jack connector 230. Thus, the pairs of signal contacts adjacent to one another in the array direction of the jack connector 230 can be effectively shielded from one another.

Fourth Embodiment

A connector in accordance with a fourth embodiment of the present invention will be described below.

Figure 12A:
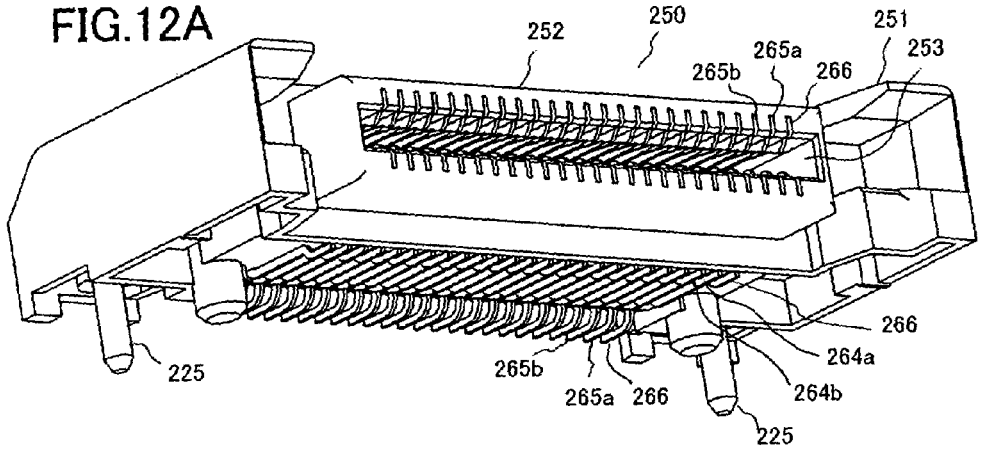
FIG. 12A is a perspective view of a jack connector in accordance with a fourth embodiment of the present invention.
Figure 12B:
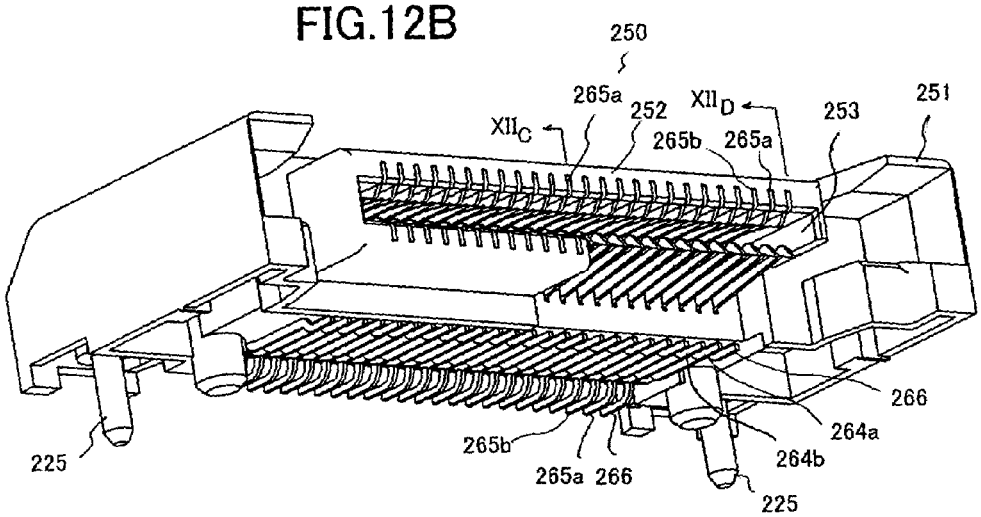
FIG. 12B is a partially cutaway perspective view of the jack connector in accordance with the fourth embodiment of the present invention.
Figure 12C:
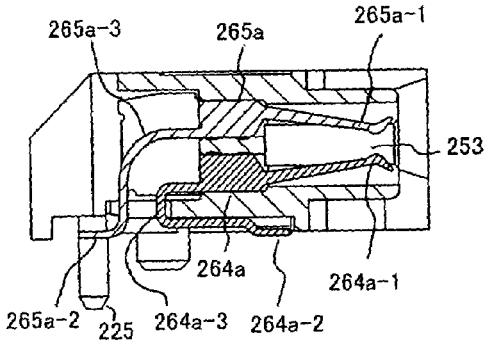
FIG. 12C is a sectional view of the jack connector, taken along the line $XII_C$ of FIG. 12B.
Figure 12D:
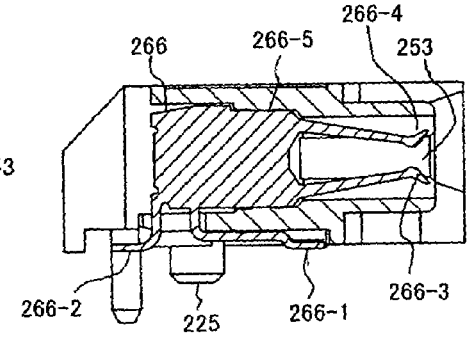
FIG. 12D is a sectional view of the jack connector, taken along the line $XII_D$ of FIG. 12B.

FIGS. 12A through 12D illustrate a jack connector 250 in accordance with the fourth embodiment. More specifically, FIG. 12A is a perspective view of the connector 250, FIG. 12B is a partially cutaway perspective view of the connector 250, FIG. 12C is a sectional view of the connector 250 taken along the line $XII_C$ of FIG. 12B, and FIG. 12D is a sectional view of the connector 250 taken along the line $XII_D$ of FIG. 12B. The jack connector 250 is to be paired with the plug connector 210.

The connector 250 includes a housing 251 having a convexity 252. The housing 251 is made of an insulating material such as polyester or liquid crystal polymer resin. The convexity 252 extends in the longitudinal direction of the connector 250, and has a concavity 253. The contact supporting member 213 of the connector 210 is to be inserted into the concavity 253. In the concavity 253, two arrays of signal contacts and ground contacts are arranged. One of the arrays includes signal contacts 264*a* and 264*b*, and the other array includes signal contacts 265*a* and 265*b*. Each one signal contact 264*a* is paired with one signal contact 264*b*, and each pair of signal contacts 264*a* and 264*b* is designed for balanced transmission of signals at a speed of 1 Gbit/s or higher. Multiple pairs of these signal contacts 264*a* and 264*b* are arranged in parallel with one another at intervals, and form one of the arrays. Likewise, each one signal contact 265*a* is paired with one signal contact 265*b*, and each pair of signal contacts 265*a* and 265*b* is designed for balanced transmission.

The pairs of signal contacts 264*a* and 264*b* are adjacent to one another over the entire length (or are uniformly arranged). Also, the pairs of signal contacts 264*a* and 264*b* extend in parallel with one another over the entire length (or are aligned at uniform intervals). This arrangement of signal contacts greatly differs from the prior art.

The multiple pairs of signal contacts 265*a* and 265*b* are arranged in parallel with one another at intervals, and constitute the other array. Accordingly, the connector 250 includes the signal contacts 264*a*, 264*b*, 265*a*, and 265*b* that are arranged in the two arrays.

The signal contacts 264*a* and 264*b* are individual members that have thin and long shapes (pin-like shapes) of uniform lengths, and may be formed by stamping out a gold-plated flat plate of a copper alloy and then bending the stamped-out parts. The signal contacts 265*a* and 265*b* are formed in the same manner. However, the lengths of the signal contacts 265*a* and 265*b* may be the same as the lengths of the signal contacts 264*a* and 264*b*, or may be different from the lengths of the signal contacts 264*a* and 264*b*, depending on the angle of the bend at the mid section of each signal contact.

Rectangular holes are formed in the housing 251, and ground contacts 266 are arranged in the rectangular holes. The ground contacts 266 divide the array of the signal contacts 264*a* and 264*b* into multiple pairs of signal contacts, and also divide the array of the signal contacts 265*a* and 265*b* into multiple pairs of signal contacts. Accordingly, between each two neighboring ground contacts 266, there exist a pair of signal contacts 264*a* and 264*b* of one array and a pair of signal contacts 265*a* and 265*b* of the other array.

As shown in FIG. 12C, each of the signal contacts 264*a* is a single member that has a connector contact part 264*a*-1 to be connected to the corresponding connector contact part 214*a*-1 of the plug connector 210, a substrate contact part 264*a*-2, and a mid-section part 264-3 existing between the connector contact part 264*a*-1 and the substrate contact part 264*a*-2. Each connector contact part 264*a*-1 penetrates through each corresponding hole formed in the housing 251, and extends along the inside of the concavity 253. With the connector 250 being mounted onto a wiring substrate, each connector contact part 264*a*-1 extends in parallel with the wiring substrate. Each substrate contact part 264*a*-2 extends in such a manner as to be connected to a connecting terminal such as a pad provided on a mounting surface of a printed circuit board (not shown). Each of the contacts 265*a* facing the contacts 264*a* via a space is also a single member that has a connector contact part 265*a*-1 to be connected to the corresponding connector contact 215*a*-1 of the plug connector 210, a substrate contact part 235*a*-2, and a mid-section part 265*a*-3 to connect the connector contact part 265*a*-1 and the substrate contact part 265*a*-2. Each connector contact part 265*a*-1 penetrates through each corresponding hole formed in the housing 251, and extends along the inside of the concavity 253. Each substrate contact part 265*a*-2 extends in such a manner as to be connected to a connection terminal such as a pad provided on a mounting surface of a printed circuit board. The substrate contacts 264*a*-2 and 265*a*-2 extend in the opposite directions. The signal contacts 264*b* are formed in the same manner as the signal contacts 264*a*, and the signal contacts 265*b* are formed in the same manner as the signal contacts 265*a*.

As a result, the connector contact parts 264*a*-1, 264*b*-1, 265*a*-1, and 265*b*-1, extend in the same direction as the substrate contact parts 264*a*-2 and 264*b*-2, while the substrate contacts 265*a*-2 and 265*b*-2 extend in the opposite direction from the substrate contact parts 264*a*-2 and 264*b*-2.

Each of the connector contact parts 264*a*-1, 264*b*-1, 265*a*-1, and 265*b*-1 has an inward protrusion, and is tilted inward so as to provide spring tension. When the plug connector 210 is attached to the jack connector 250, the connector contact parts 214*a*-1, 214*b*-1 215*a*-1, and 215*b*-1 of the plug connector 210 are engaged with the corresponding connector contact parts 264*a*-1, 264*b*-1, 265*a*-1, and 265*b*-1, and the inward protrusions pushes outward the connector contact parts 214*a*-1, 214*b*-1 215*a*-1, and 215*b*-1. By virtue of the spring restoring force of the connector contact parts 234*a*-1, 234*b*-1, 235*a*-1, and 235*b*-1, electric connection can be surely established.

As shown in FIG. 12D, each of the ground contacts 266 has two substrate contact parts 266-1 and 266-2, two connector contact parts 266-3 and 266-4, and a base part 266-5. Each of the contact parts 266-1 through 266-4 and the base parts 266-5 is a single member that may be formed by stamping out a gold-plated flat panel of a copper alloy and then bending the stamped-out part. Each of the connector contact parts 266-3 and 266-4 penetrates through each corresponding hole formed in the housing 251, and extends along the inside of the concavity 253. Each two adjacent connector contact parts 266-3 and 266-4 face each other via a space. Each of the connector contact parts 266-3 and 366-4 has an inward protrusion, and is tilted inward so as to provide spring tension. In other words, the connector contact parts 266-3 and 266-4 are the same as the connector contact parts 264*a*-1 and 265*a*-1 shown in FIG. 12C. When the plug connector 210 is attached to the jack connector 250, the protrusions of the connector contact parts 266-3 and 266-4 are engaged with the corresponding ground contacts 216 of the plug connector 210, and pushes these connector contact parts outward. Thus, electric connection can be surely established. The substrate contact parts 266-1 and 266-2 are bent outward at approximately 90 degrees with respect to the base parts 266-5, and extend in the opposite directions. In this structure, an array of multiple pairs of substrate contact parts 264*a*-2 and 264*b*-2, with a substrate ground contact part 266-1 being interposed between each two neighboring pairs, and an array of multiple pairs of substrate contact parts 265*a*-2 and 265*b*-2, with a substrate ground contact part 266-2 being interposed between each two neighboring pairs, are formed on the side of the wiring substrate. The two arrays of substrate contact parts exist on the same plane (a mounting surface), and extend in the opposite directions.

The substrate contact parts 264*a*-2 and 264*b*-2 in each pair extend in parallel with each other and have the same lengths, so that signals can be balanced-transmitted in the same phase. Likewise, the substrate contact parts 265*a*-2 and 265*b*-2 in each pair expend in parallel with each other and have the same lengths, so that signals can be transmitted in the same phase under the balanced condition. As a result, noise that was caused by a phase difference in the prior art can be prevented, and the characteristic impedance can be stabilized. Also, the substrate contact parts 264*a*-2 and 264*b*-2 are adjacent to one another at uniform intervals, and the substrate contact parts 235*a*-2 and 235*b*-2 are also adjacent to one another at uniform intervals. Thus, the lengths of each pair of wires on the wiring substrate can be easily made uniform, and the wiring design and the wiring operation for the wiring substrate can be readily simplified.

When the jack connector 250 and the plug connector 210 are connected to each other, the ground contacts 216 of the plug connector 210 are inserted between the pairs of signal contacts adjacent to one another in the array direction of the jack connector 250. Thus, the pairs of signal contacts adjacent to one another in the array direction of the jack connector 250 can be effectively shielded from one another.

Fifth Embodiment

A connector in accordance with a fifth embodiment of the present invention will be now described below.

Figure 13A:
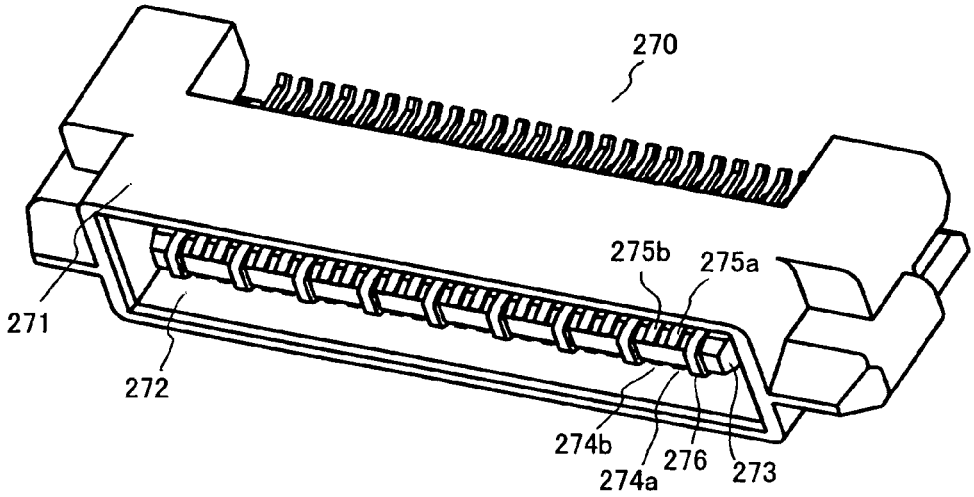
FIG. 13A is a perspective view of a plug connector in accordance with a fifth embodiment of the present invention.
Figure 13B:
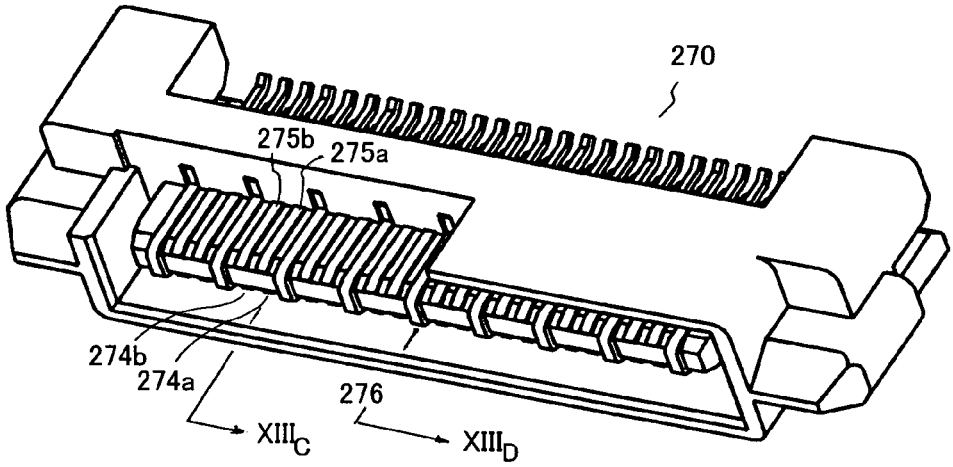
FIG. 13B is a partially cutaway perspective view of the plug connector in accordance with the fifth embodiment of the present invention.
Figure 13C:
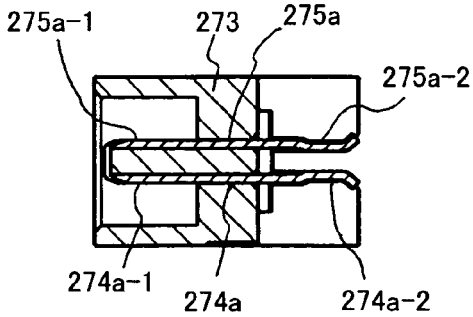
FIG. 13C is a sectional view of the plug connector, taken along the line $XIII_C$ of FIG. 13B.
Figure 13D:
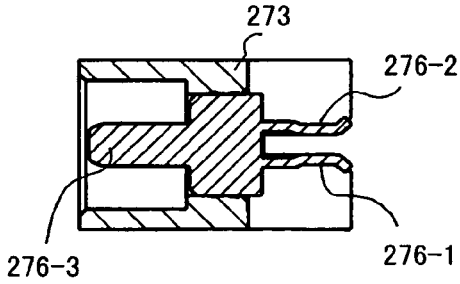
FIG. 13D is a sectional view of the plug connector, taken along the line $XIII_D$ of FIG. 13B.

FIGS. 13A through 13D illustrate a plug connector 270 in accordance with the fifth embodiment. More specifically, FIG. 13A is a perspective view of the connector 270, FIG. 13B is a partially cutaway perspective view of the connector 270, FIG. 13C is a sectional view of the connector 270 taken along the line $XIII_C$ of FIG. 13B, and FIG. 13D is a sectional view of the connector 270 taken along the line $XIII_D$ of FIG. 13B. Although the connectors of the foregoing embodiments are to be mounted onto a mounting surface of a wiring substrate, the connector 270 of the fifth embodiment is to be mounted to a wiring substrate, with the wiring substrate being interposed in the connector 270. The substrate contact parts described later can be connected to connection terminals provided on two opposite planes of a wiring substrate.

The connector 270 includes a housing 271 having a concavity 272. The housing 271 is made of an insulating material such as polyester or liquid crystal polymer resin. A contact supporting member 273 extending in the longitudinal direction of the connector 270 is provided in the concavity 272. The contact supporting member 273 may be integrally formed with the housing 271, and has a panel-like shape. The contact supporting member 273 has two facing planes, and signal contacts 274*a*, 274*b*, 275*a*, and 275*b* are arranged on the two planes. Each one signal contact 274*a* is paired with one signal contact 274*b*, and each pair of signal contacts 274*a* and 274*b* is designed for balance transmission of signals at a speed higher than 1 Gbit/s or higher. Accordingly, signals of the same sizes and the opposite polarities are transmitted through each pair of signal contacts 274*a* and 274*b*.

The pairs of signal contacts 274*a* and 274*b* are adjacent to one another over the entire length, and are uniformly arranged. Also, the pairs of signal contacts 274*a* and 274*b* extend in parallel with one another over the entire length, and are aligned at uniform intervals.

The multiple pairs of signal contacts 274*a* and 274*b* are arranged in parallel with one another at intervals on one of the two planes of the contact supporting member 273. Accordingly, the signal contacts 274*a* and 274*b* are aligned at intervals in one array in the longitudinal direction of the housing 271. Likewise, each one signal contact 275*a* is paired with one signal contact 275*b*, and each pair of signal contacts 275*a* and 275*b* is designed for balanced transmission. The multiple pairs of signal contacts 275*a* and 275*b* are arranged in parallel with one another at intervals on the other plane of the contact supporting member 273. Accordingly, the signal contacts 275*a* and 275*b* are aligned in one array at intervals in the longitudinal direction of the housing 271. Thus, the connector 270 has a two-array structure that includes the array of signal contacts 274*a* and 274*b* and the array of signal contacts 275*a* and 275*b*.

The signal contacts 274*a*, 274*b*, 275*a*, and 275*b*, are individual members that have thin and long shapes of uniform lengths, and may be formed by stamping out a gold-plated flat plate of a copper alloy and then bending the stamped-out parts.

Rectangular holes are formed in the contact supporting member 273, and ground contacts 276 are arranged in the rectangular holes. The ground contacts 276 divide the array of the signal contacts 274*a* and 274*b* into multiple pairs of signal contacts, and also divide the array of the signal contacts 275*a* and 275*b* into multiple pairs of signal contacts. Accordingly, between each two neighboring ground contacts 276, there exist a pair of signal contacts 274*a* and 274*b* of one array and a pair of signal contacts 275*a* and 275*b* of the other array.

As shown in FIG. 13C, each of the signal contacts 274*a* has a connector contact part 274*a*-1 to be connected to the jack connector 230 or 250, and a substrate contact part 274*a*-2 that is integrally formed with the connector contact part 274*a*-1. Likewise, each of the signal contacts 275*a* has a connector contact part 275*a*-1 to be connected to the jack connector 230 or 250, and a substrate contact part 275*a*-2 that is integrally formed with the connector contact part 275*a*-1. Each of the connector contact parts 274*a*-1 and 275*a*-1 penetrates through each corresponding hole formed in the housing 271, and extends along the facing planes of the contact supporting member 273. Each of the substrate contact parts 274*a*-2 and 275*a*-2 linearly and continuously extends from each corresponding one of the connector contact parts 274*a*-1 and 275*a*-1. Also, the substrate contact parts 274*a*-2 and 275*a*-2 extend in the opposite direction from the connector contact parts 274*a*-1 and 275*a*-1. Each two adjacent substrate contact parts 274*a*-2 and 275*a*-2 face each other via a space, and are slightly bent inward. The distance between each two adjacent substrate contact parts 274*a*-2 and 275*a*-2 is slightly shorter than the distance between each two adjacent connector contact parts 274*a*-1 and 275*a*-1. A wiring substrate is inserted between the substrate contact parts 274*a*-2 and the substrate contact parts 275*a*-2. The insides of the substrate contact parts 274*a*-2 and 275*a*-2 are engaged with the corresponding contact parts of a mating connector. The thickness of the wiring substrate is greater than the space between the substrate contact parts 274*a*-2 and the substrate contact parts 275*a*-2. As a result, the substrate contact parts 274*a*-2 and the substrate contact parts 275*a*-2 are pushed outward. By virtue of the restoring force of the substrate contact parts 274*a*-2 and 275*a*-2, electric contact with the connection electrodes provided on the two facing planes of the wiring substrate can be surely established. The signal contacts 274*b* and 275*b* have the same structures as the signal contacts 274*a* and 275*a*, respectively.

As shown in FIG. 13D, each of the ground contacts 276 has two substrate contact parts 276-1 and 276-2, and a plate-like part 276-3 that is integrally formed with the substrate contact parts 276-1 and 276-2. The ground contacts 276 are provided in both two arrays of signal contacts. Each of the plate-like parts 276-3 penetrates through each corresponding hole formed in the housing 271 and the contact supporting member 273, and extends in the vertical direction. The top of each plate-like part 276-3 protrudes from the upper surface of the contact supporting member 273. The width of each plate-like part 276-3 is greater than the distance between each two adjacent signal contacts 274*a* (274*b*) and 275*a* (275*b*). The substrate contact parts 276-1 and 276-2 of the ground contacts 276 extend in the same direction, and are slightly bent inward. Each two adjacent substrate contact parts 276-1 and 276-2 face each other via a space. The distance between each two adjacent substrate contact parts 276-1 and 276-2 is equal to the distance between each two adjacent substrate contact parts 274*a*-2 and 275*a*-2.

In this structure, an array of multiple pairs of substrate contact parts 274*a*-2 and 274*b*-2, with a substrate ground contact part 276-1 being interposed between each two neighboring pairs, and an array of multiple pairs of substrate contact parts 275*a*-2 and 275*b*-2, with a substrate ground contact part 276-2 being interposed between each two neighboring pairs, are formed on the side of the wiring substrate. The two arrays of contact parts exist on different planes (the two opposite mounting surfaces), and extend in the same direction (from the bottom of the housing 271).

The substrate contact parts 274*a*-2 and 274*b*-2 in each pair extend in parallel with each other and have the same lengths, so that signals can be balanced-transmitted in the same phase on the wiring substrate. Likewise, the substrate contact parts 275*a*-2 and 275*b*-2 in each pair expend in parallel with each other and have the same lengths, so that signals can be balanced-transmitted in the same phase on the wiring substrate. As a result, noise that was caused by a phase difference in the prior art can be prevented, and the characteristic impedance can be stabilized. Also, the lengths of each pair of wires on the wiring substrate can be easily made uniform, and the wiring design and the wiring operation for the wiring substrate can be readily simplified.

Modifications

Modifications of the third embodiment, the fourth embodiment, and the fifth embodiments, will now be described below. In each of the following modifications, the structure for balanced-transmission high-speed signals of any of the third through fifth embodiments is combined with a structure for transmitting low-speed signals.

Figure 14A:
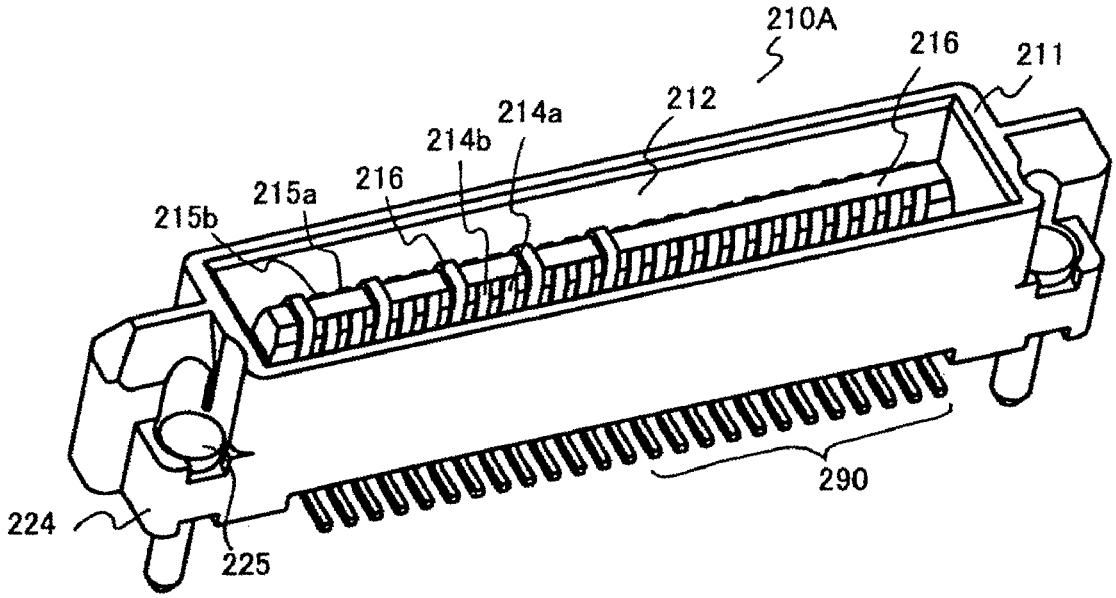
FIG. 14A is a perspective view of a plug connector that is a modification of the third embodiment of the present invention.
Figure 14B:
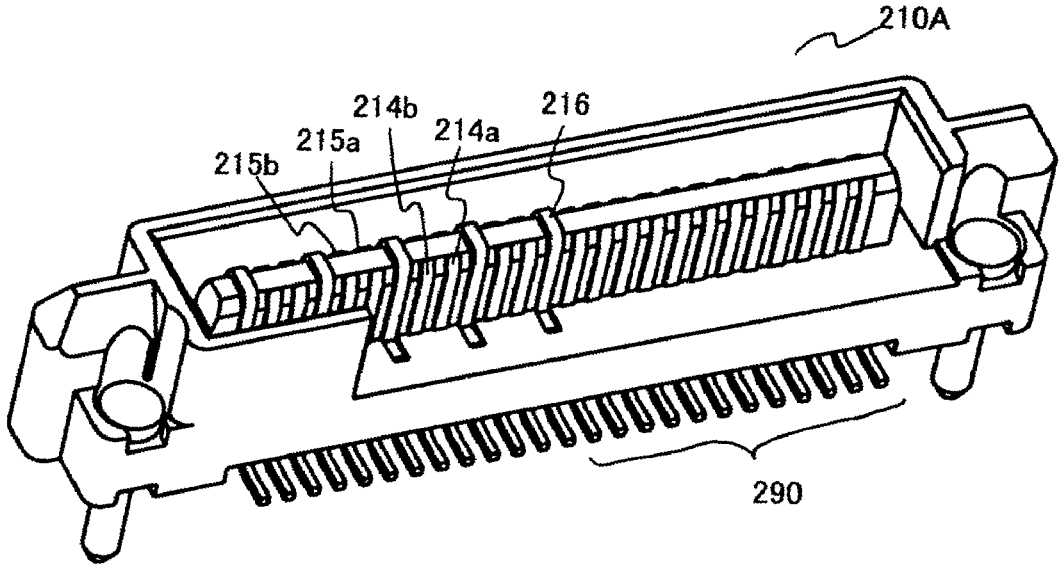
FIG. 14B is a partially cutaway perspective view of the plug connector that is a modification of the third embodiment.

FIGS. 14A and 14B illustrate a plug connector 210A that is a modification of the plug connector 210 of the third embodiment. In the drawings, the same components as those in FIGS. 10A through 10D are denoted by the same reference numerals as those in FIGS. 10A through 10D. Reference numeral 290 in FIGS. 14A and 14B indicates an area in which only signal contacts are provided. Hereinafter, the area 290 will be referred to as the "low-speed signal area". In the low-speed signal area 290, ground contacts 216 for dividing signal contacts into pairs are not provided, and signal contacts are successively arranged at intervals. The low-speed signal area 290 has a two-array structure including an array that continues to the array of signal contacts 214*a* and 214*b* for high-speed signal balanced-transmission, and an array that continues to the array of signal contacts 215*a* and 215*b*. The signal contacts arranged in the low-speed signal area 290 each has the same structure as a signal contact 214*a* or the like.

Accordingly, the connector 210A is a complex connector that realizes both high-speed signal balanced transmission and low-speed signal unbalanced transmission. The location of the low-speed signal area 290 is not limited to the location shown in the drawings, but may be at the left side or in the center of each drawing. Alternatively, multiple low-speed signal areas 290 may be arranged among high-speed signal areas.

Figure 15A:
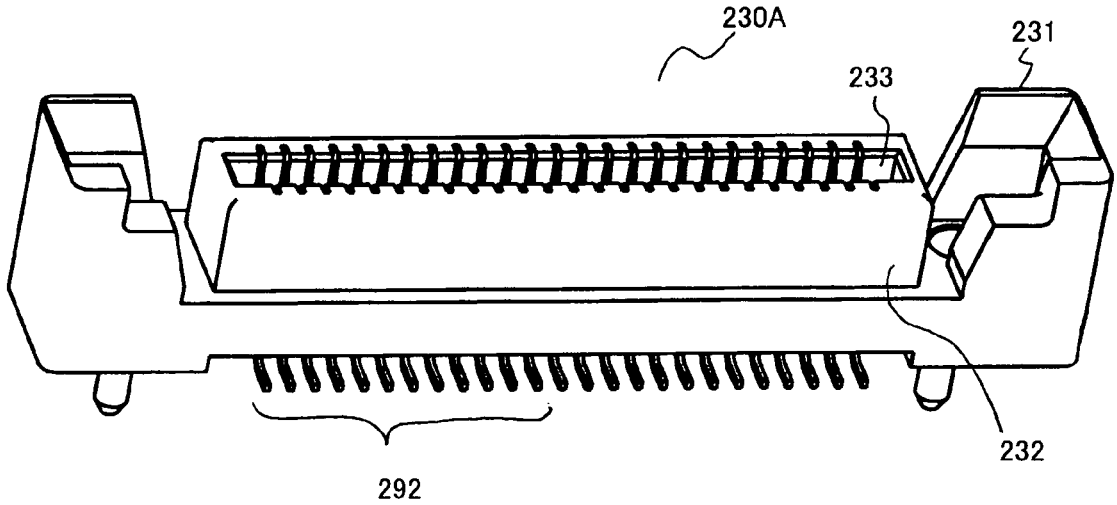
FIG. 15A is a perspective view of a jack connector that is a modification of the third embodiment of the present invention.
Figure 15B:
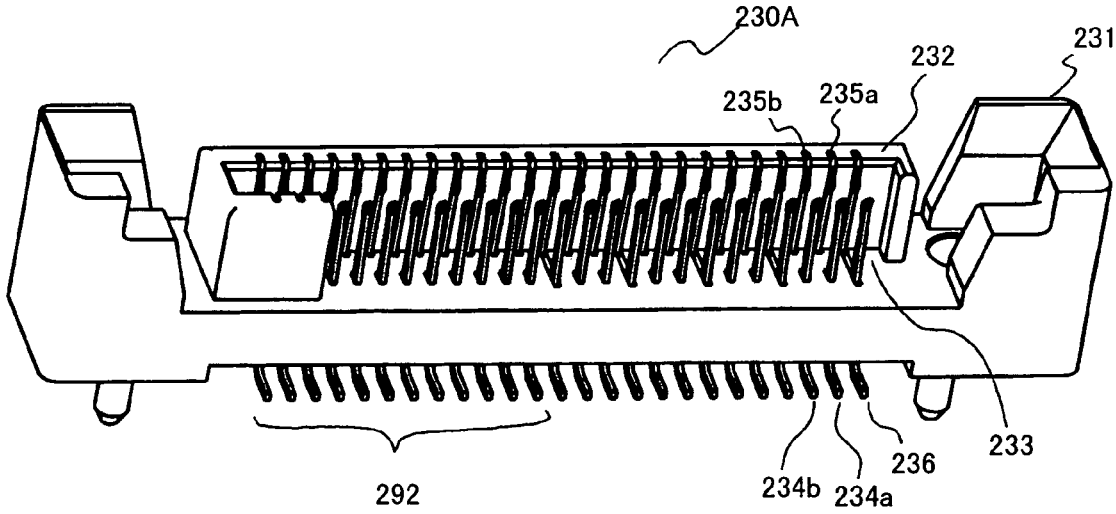
FIG. 15B is a partially cutaway perspective view of the jack connector that is a modification of the third embodiment.

FIGS. 15A and 15B illustrate a jack connector 230A that is a modification of the jack connector 230 of the third embodiment. In the drawings, the same components as those in FIGS. 11A through 11D are denoted by the same reference numerals as those in FIGS. 11A through 11D. Reference numeral 292 in FIGS. 15A and 15B indicates an area in which only signal contacts are provided. Hereinafter, the area 292 will be referred to as the "low-speed signal area". In the low-speed signal area 292, ground contacts for dividing signal contacts into pairs are not provided, and signal contacts are successively arranged at intervals. The low-speed signal area 292 has a two-array structure including an array that continues to the array of signal contacts 234*a* and 234*b* for high-speed signal balanced transmission, and an array that continues to the array of signal contacts 235*a* and 235*b*. Each of the signal contacts arranged in the low-speed signal area 292 has the same structure as a signal contact 234*a* or the like.

Accordingly, the connector 230A is a complex connector through which both high-speed signals and low-speed signals can be efficiently transmitted. The location of the low-speed signal area 292 is not limited to the location shown in the drawings, but may be at the right side or in the center of each drawing. Alternatively, multiple low-speed signal areas 292 may be arranged among high-speed signal areas.

Figure 16A:
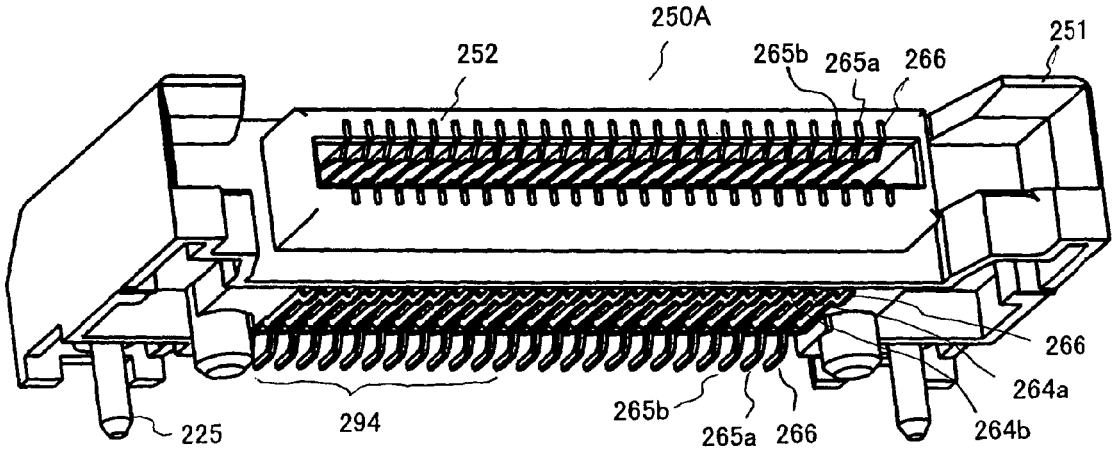
FIG. 16A is a perspective view of a jack connector that is a modification of the fourth embodiment of the present invention.
Figure 16B:
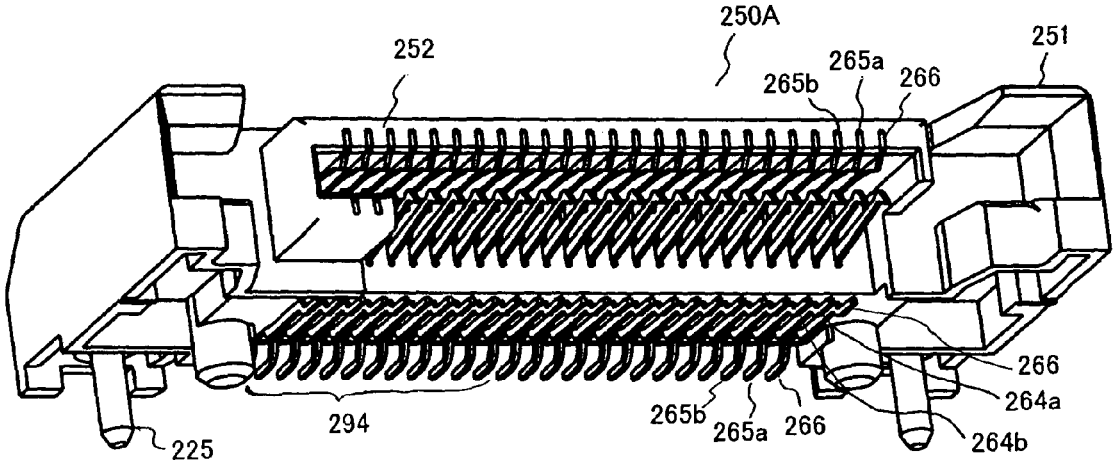
FIG. 16B is a partially cutaway perspective view of the jack connector that is a modification of the fourth embodiment.

FIGS. 16A and 16B illustrate a jack connector 250A that is a modification of the jack connector 250 of the fourth embodiment. In the drawings, the same components as those in FIGS. 12A through 12D are denoted by the same reference numerals as those in FIGS. 12A through 12D. Reference numeral 294 in FIGS. 16A and 16B indicates an area in which only signal contacts are provided. Hereinafter, the area 294 will be referred to as the "low-speed signal area". In the low-speed signal area 294, ground contacts for dividing signal contacts into pairs are not provided, and signal contacts are successively arranged at intervals. The low-speed signal area 294 has a two-array structure including an array that continues to the array of signal contacts 264*a* and 264*b* for high-speed signal balanced transmission, and an array that continues to the array of signal contacts 265*a* and 265*b*. Each of the signal contacts arranged in the low-speed signal area 294 has the same structure as a signal contact 264*a* or the like.

Accordingly, the connector 250A is a complex connector through which both high-speed signals and low-speed signals can be efficiently transmitted. The location of the low-speed signal area 294 is not limited to the location shown in the drawings, but may be at the right side or in the center of each drawing. Alternatively, multiple low-speed signal areas 294 may be arranged among high-speed signal areas.

Figure 17A:
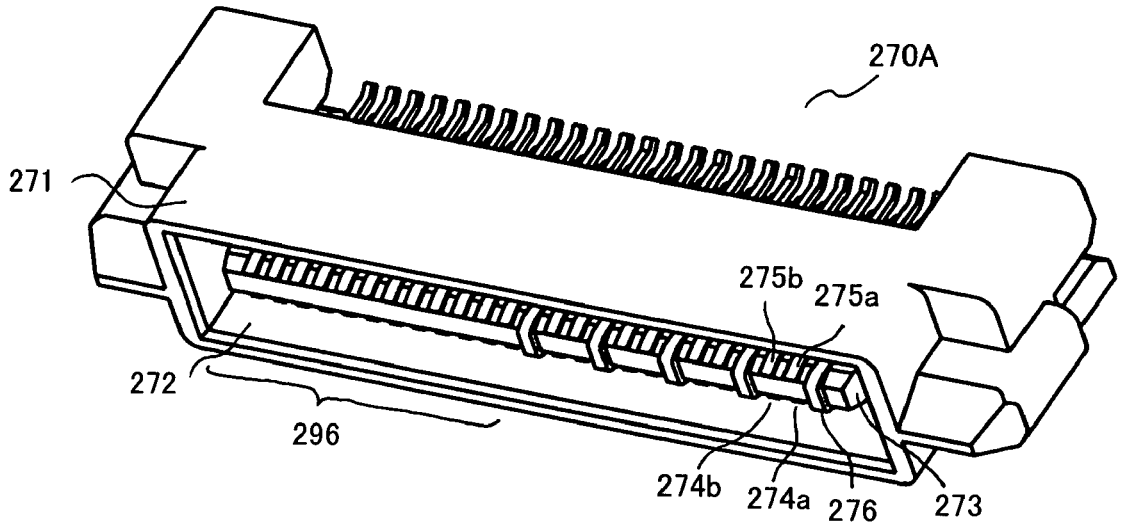
FIG. 17A is a perspective view of a plug connector that is a modification of the fifth embodiment of the present invention.
Figure 17B:
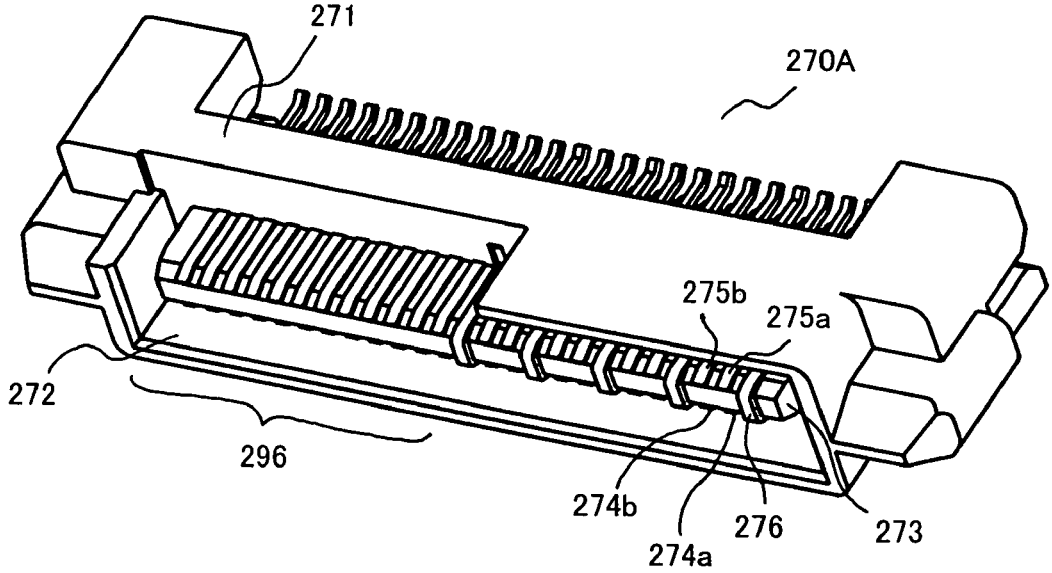
FIG. 17B is a partially cutaway perspective view of the plug connector that is a modification of the fifth embodiment.

FIGS. 17A and 17B illustrate a plug connector 270A that is a modification of the jack connector 270 of the fifth embodiment. In the drawings, the same components as those in FIGS. 13A through 13D are denoted by the same reference numerals as those in FIGS. 13A through 13D. Reference numeral 296 in FIGS. 17A and 17B indicates an area in which only signal contacts are provided. Hereinafter, the area 296 will be referred to as the "low-speed signal area". In the low-speed signal area 296, ground contacts for dividing signal contacts into pairs are not provided, and signal contacts are successively arranged at intervals. The low-speed signal area 296 has a two-array structure including an array that continues to the array of signal contacts 274*a* and 274*b* for high-speed signal balanced transmission, and an array that continues to the array of signal contacts 275*a* and 275*b*. Each of the signal contacts arranged in the low-speed signal area 296 has the same structure as a signal contact 274*a* or the like.

Accordingly, the connector 270A is a complex connector through which both high-speed signals and low-speed signals can be efficiently transmitted. The location of the low-speed signal area 296 is not limited to the location shown in the drawings, but may be at the right side or in the center of each drawing. Alternatively, multiple low-speed signal areas 296 may be arranged among high-speed signal areas.

So far, the embodiments of the present invention and the modifications of the embodiments have been described. Any of the modifications of the third through fifth embodiments can be applied to the first and second embodiments, so as to form a complex connector. Also, the shielding metal plate employed in the first and second embodiments can be employed in any of the third through fifth embodiment and the modifications. Although the substrates shown in the drawings illustrating the first and second embodiments are not shown in the drawings illustrating the third through fifth embodiments and the modifications, any of the connectors of the third through fifth embodiments and the modifications can be mounted onto a substrate, and a wiring operation is thus carried out so as to form an electronic device.

What is claimed is:

1. A connector comprising:

a housing; and multiple pairs of signal contacts, each two signal contacts that are paired with each other being arranged side by side at a distance in the longitudinal direction of the housing, the multiple pairs of signal contact being arranged so as to form multiple arrays arranged side by side in the transverse direction of the housing, each of the multiple pairs of signal contacts that have an identical length being designed for balanced transmission;

panel-shaped ground contacts provided between respective, neighboring pairs of the multiple pairs of signal contact in each of the multiple arrays, each of the panel-shaped ground contacts being of a size sufficient to shield the multiple pairs of signal contacts from each neighboring pair and being provided commonly to the multiple arrays arranged side by side in the transverse direction of the housing; and an array intermediate ground contact betweeneach two neighboring arrays of the multiple pairs of signal contacts, wherein:

each of the ground contacts has a pair of contact parts;

one of the pair of contact parts is aligned with substrate contact parts of the multiple pairs of signal contacts arranged in one of the arrays; and the other one of the pair of contact parts is aligned with substrate contact parts of the multiple pairs of signal contacts arranged in another one of the two arrays.

2. The connector as claimed in claim 1, wherein:

the multiple pairs of signal contacts are of a surface mounting type, having respective bent ends in contact with corresponding pads on a substrate; and the bent ends of all the multiple pairs of signal contacts extend in parallel with one another.

3. The connector as claimed in claim 1, further comprising a shielding layer that is formed on the exterior of the housing.

4. A connector, comprising: signal contacts arranged in two arrays and of a common length; and panel-shaped ground contacts that are commonly provided in the two arrays and divide each array of signal contacts into multiple pairs, the multiple pairs of signal contacts being adjacent to one another throughout the common length thereof, wherein each of the ground contacts has a pair of contact parts;

one of the pair of contact parts is aligned with substrate contact parts of the signal contacts arranged in one of the two arrays; and the other one of the pair of contact parts is aligned with substrate contact parts of the signal contacts arranged in the other one of the two arrays.

5. The connector as claimed in claim 4, wherein substrate contact parts of the multiple pairs of signal contacts, arranged in one of the two arrays, extend in an opposite direction from substrate contact parts of the multiples pairs of signal contacts arranged in the other one of the two arrays.

6. The connector as claimed in claim 4, wherein substrate contact parts of the multiple pairs of signal contacts, arranged in one of the two arrays, face substrate contact parts of the multiple pairs of signal contacts arranged in the other one of the two arrays, all the substrate contact parts extending in the same direction.

7. The connector as claimed in claim 4, wherein a pair of signal contacts arranged in one of the two arrays and a pair of signal contacts arranged in the other one of the two arrays exist between each two neighboring ground contacts.

8. The connector as claimed in claim 4, wherein a pair of signal contacts arranged in one of the two arrays and a pair of signal contacts arranged in the other array that faces the one of the two arrays via an insulating member exist between each two neighboring ground contacts.

9. The connector as claimed in claim 4, wherein a pair of signal contacts arranged in one of the two arrays and a pair of signal contacts arranged in the other array that faces the one of the two arrays via a space exist between each two neighboring ground contacts.

10. The connector as claimed in claim 4, wherein each of the ground contacts is provided across both two arrays, and has top ends facing each other.

11. The connector as claimed in claim 4, wherein parts of the signal contacts to be connected to a mating connector extend in a direction perpendicular to parts of the signal contacts to be connected to a substrate.

12. The connector as claimed in claim 4, wherein parts of the signal contacts to be connected to a mating connector extend in the opposite direction from parts of the signal contacts to be connected to a substrate.

13. The connector as claimed in claim 4, wherein the signal contacts arranged in the two arrays are aligned at intervals in the longitudinal direction of the connector.

14. The connector as claimed in claim 4, further comprising other signal contacts that are provided in each array, the other signal contacts in each array are arranged at intervals, without the ground contacts being interposed among the other signal contacts.

15. An electronic device comprising:

a wiring substrate; and a connector that is mounted to the wiring substrate, the connector comprising:

a housing, multiple pairs of signal contacts, each two signal contacts that are paired with each other being arranged side by side at a distance in the longitudinal direction of the housing, the multiple pairs of signal contacts being arranged so as to form multiple arrays, arranged side by side in the transverse direction of the housing, each of the multiple pairs of signal contacts that have an identical length being designed for balanced transmission, and panel-shaped ground contacts provided between respective, neighboring pairs of the multiple pairs of signal contacts in each of the multiple arrays, each of the panel-shaped ground contacts being large enough to shield the multiple pairs of signal contacts from each neighboring pair and being provided commonly to the multiple arrays arranged side by side in the transverse direction of the housing wherein:

each of the ground contacts has a pair of contact parts;

one of the pair of contact parts is aligned with substrate contact parts of the multiple pairs of signal contacts arranged in one of the arrays; and the other one of the pair of contact parts is aligned with substrate contact parts of the multiple pairs of signal contacts arranged in the another one of the two arrays.

16. An electronic device comprising:

a wiring substrate; and a connector that is mounted to the wiring substrate, the connector comprising:

signal contacts arranged in two arrays and of a common length, panel-shaped ground contacts that are commonly provided to the two arrays and divide each array of signal contacts into multiple pairs, and the multiple pairs of signal contacts being adjacent to one another throughout the common lengths thereof, wherein:

each of the ground contacts has a pair of contact parts;

one of the pair of contact parts is aligned with substrate contact parts of the signal contacts arranged in one of the two arrays; and the other one of the pair of contact parts is aligned with substrate contact parts of the signal contacts arranged in the other one of the two arrays.

* * * * *

UNITED STATES PATENT AND TRADEMARK OFFICE

CERTIFICATE OF CORRECTION

PATENT NO. : 6,981,898 B2
APPLICATION NO. : 10/613028
DATED : January 3, 2006
INVENTOR(S) : Junichi Akama et al.

It is certified that error appears in the above-identified patent and that said Letters Patent is hereby corrected as shown below:

Column 25, Line 9, delete “betweeneach” and insert - - between each - - therefor.
Column 25, Line 34, after “wherein” insert - - : - -.
Column 26, Line 37, after “housing” insert - - , - -.
Col. 26 Line 41, Delete “;” and insert : --therefor Signed and Sealed this First Day of August, 2006

JON W. DUDAS
*Director of the United States Patent and Trademark Office*